US010477323B2

(12) United States Patent
Higashi et al.

(10) Patent No.: US 10,477,323 B2
(45) **Date of Patent: *Nov. 12, 2019**

(54) MICROPHONE PACKAGE

(71) Applicant: Kabushiki Kaisha Toshiba, Minato-ku (JP)

(72) Inventors: Yoshihiro Higashi, Kanagawa-ken (JP); Yoshihiko Fuji, Kanagawa-ken (JP); Michiko Hara, Kanagawa-ken (JP); Akiko Yuzawa, Kanagawa-ken (JP); Shiori Kaji, Kanagawa-ken (JP); Tomohiko Nagata, Kanagawa-ken (JP); Akio Hori, Kanagawa-ken (JP); Hideaki Fukuzawa, Kanagawa-ken (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/053,832

(22) Filed: Aug. 3, 2018

(65) Prior Publication Data

US 2018/0352342 A1 Dec. 6, 2018

Related U.S. Application Data

(63) Continuation of application No. 15/373,011, filed on Dec. 8, 2016, now Pat. No. 10,070,230, which is a (Continued)

(30) Foreign Application Priority Data

Nov. 20, 2012 (JP) ..... 2012-254357

(51) Int. Cl.
*H04R 25/00* (2006.01)
*H04R 19/04* (2006.01)
(Continued)

(52) U.S. Cl.
CPC ..... *H04R 19/04* (2013.01); *H04R 1/04* (2013.01); *H04R 7/10* (2013.01)

(58) Field of Classification Search
CPC ..... H04R 19/04; H04R 1/04; H04R 7/10
(Continued)

(56) References Cited

U.S. PATENT DOCUMENTS 5,303,594 A * 4/1994 Kurtz ..... G01L 9/0055 338/4
6,781,231 B2 8/2004 Minervini
(Continued)

FOREIGN PATENT DOCUMENTS

JP 10-170377 A 6/1998
JP 2003-37312 A 2/2003
(Continued)

*Primary Examiner* — Phylesha Dabney
(74) *Attorney, Agent, or Firm* — Oblon, McClelland, Maier & Neustadt, L.L.P.

(57) ABSTRACT

According to one embodiment, a microphone package includes: a pressure sensing element including a film and a device; and a cover. The film generates strain in response to pressure. The device includes: a first electrode; a second electrode; and a first magnetic layer. The first magnetic layer is provided between the first electrode and the second electrode and has a first magnetization. The cover includes: an upper portion; and a side portion. The side portion is magnetic and provided depending on the first magnetization and the second magnetization.

14 Claims, 13 Drawing Sheets

Related U.S. Application Data continuation of application No. 14/045,153, filed on Oct. 3, 2013, now Pat. No. 9,549,261.

(51) Int. Cl.
*H04R 7/10* (2006.01)
*H04R 1/04* (2006.01)

(58) Field of Classification Search
USPC ..... 381/191, 174; 257/684
See application file for complete search history.

(56) References Cited

U.S. PATENT DOCUMENTS

| | | | | |
|---|---|---|---|---|
| 7,404,247 | B2 * | 7/2008 | Eriksen | G01L 9/0042 257/301 |
| 8,553,921 | B2 | 10/2013 | Yao | |
| 8,670,579 | B2 | 3/2014 | Wu | |
| 8,705,775 | B2 | 4/2014 | Sheplak | |
| 9,250,142 | B2 * | 2/2016 | Fukuzawa | B81B 3/0086 |
| 9,549,261 | B2 * | 1/2017 | Higashi | H04R 7/10 |
| 10,070,230 | B2 * | 9/2018 | Higashi | H04R 7/10 |
| 2004/0232536 | A1 | 11/2004 | Fukuzumi | |
| 2011/0127998 | A1 | 6/2011 | Elian et al. | |
| 2011/0295128 | A1 | 12/2011 | Yuasa et al. | |
| 2012/0079887 | A1 | 4/2012 | Giddings et al. | |
| 2013/0170669 | A1 | 7/2013 | Fukuzawa et al. | |
| 2014/0069200 | A1 * | 3/2014 | Yuasa | G01L 9/16 73/725 |
| 2014/0082901 | A1 | 3/2014 | Yeh | |
| 2014/0090486 | A1 | 4/2014 | Fuji | |
| 2014/0137658 | A1 * | 5/2014 | Higashi et al. | H04R 7/10 73/779 |
| 2014/0137668 | A1 | 5/2014 | Fukuzawa | |
| 2014/0369530 | A1 | 12/2014 | Fuji | |
| 2015/0082888 | A1 | 3/2015 | Otsu | |
| 2015/0082894 | A1 | 3/2015 | Okamoto | |
| 2015/0082899 | A1 | 3/2015 | Kaji | |
| 2015/0082900 | A1 | 3/2015 | Fuji | |
| 2015/0082917 | A1 | 3/2015 | Fuji | |
| 2015/0082919 | A1 | 3/2015 | Higashi | |
| 2015/0088008 | A1 | 3/2015 | Fuji | |
| 2015/0266717 | A1 | 9/2015 | Okamoto | |

FOREIGN PATENT DOCUMENTS

| | | | |
|---|---|---|---|
| JP | 2004-349476 | A | 12/2004 |
| JP | 2005-221418 | A | 8/2005 |
| JP | 2005-249795 | A | 9/2005 |
| JP | WO 2008/114728 | A1 | 9/2008 |
| JP | 2010-35070 | A | 2/2010 |
| JP | 2010-78481 | A | 4/2010 |
| JP | WO 2011/046091 | A1 | 4/2011 |
| JP | 2011-223422 | A | 11/2011 |
| JP | 2012-78186 | A | 4/2012 |

* cited by examiner

MICROPHONE PACKAGE

CROSS-REFERENCE TO RELATED APPLICATIONS

This application is a continuation application of U.S. application Ser. No. 15/373,011, filed Dec. 8, 2016, now U.S. Pat. No. 10,070,230, issued Sep. 4, 2018; which is a continuation application of U.S. application Ser. No. 14/045,153, filed on Oct. 3, 2013, now U.S. Pat. No. 9,549,261, issued Jan. 17, 2017; and is based upon and claims the benefit of priority from Japanese Patent Application No. 2012-254357, filed on Nov. 20, 2012; the entire contents of which are incorporated herein by reference. in the claims

FIELD

Embodiments described herein relate generally to a microphone package.

BACKGROUND

A magnetoresistive effect element can be used to configure a pressure sensing element. This makes it possible to sense pressure change based on the change of the angle between the magnetization of the magnetization free layer and the magnetization of the reference layer. In a microphone package including a pressure sensing element based on a magnetoresistive effect element, the external magnetic field due to e.g. geomagnetism may act as external noise on at least one of the magnetization of the magnetization free layer and the magnetization of the reference layer.

DETAILED DESCRIPTION

Figure 1A:
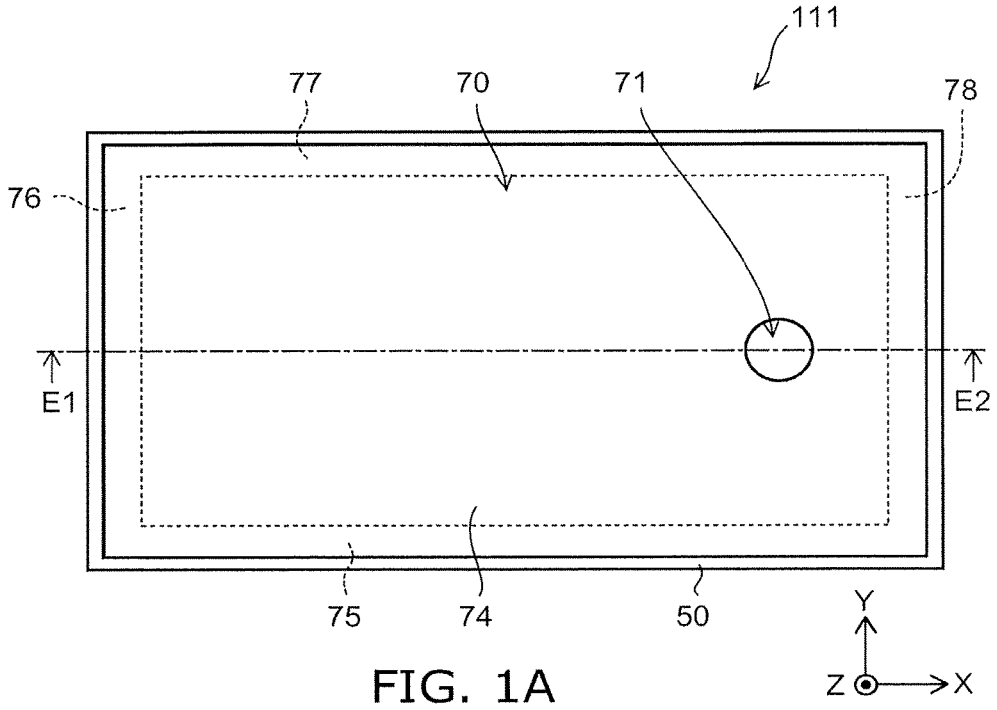
FIGS. 1A and 1B are schematic views illustrating the configuration of a microphone package according to a first embodiment.

In general, according to one embodiment, a microphone package includes: a pressure sensing element including a film and a device; and a cover. The film generates strain in response to pressure. The device is provided on the film. The device includes: a first electrode; a second electrode; and a first magnetic layer. The first magnetic layer is provided between the first electrode and the second electrode and has a first magnetization. The cover includes: an upper portion; and a side portion. The upper portion is provided with a hole configured to passing sound. The side portion is magnetic and provided depending on the first magnetization and the second magnetization. The cover houses therein the pressure sensing element.

Embodiments of the invention will now be described with reference to the drawings.

The drawings are schematic or conceptual. The relationship between the thickness and the width of each portion, and the size ratio between the portions, for instance, are not necessarily identical to those in reality. Furthermore, the same portion may be shown with different dimensions or ratios depending on the figures.

In the present specification and the drawings, components similar to those described previously with reference to earlier figures are labeled with like reference numerals, and the detailed description thereof is omitted appropriately.

Figure 1B:
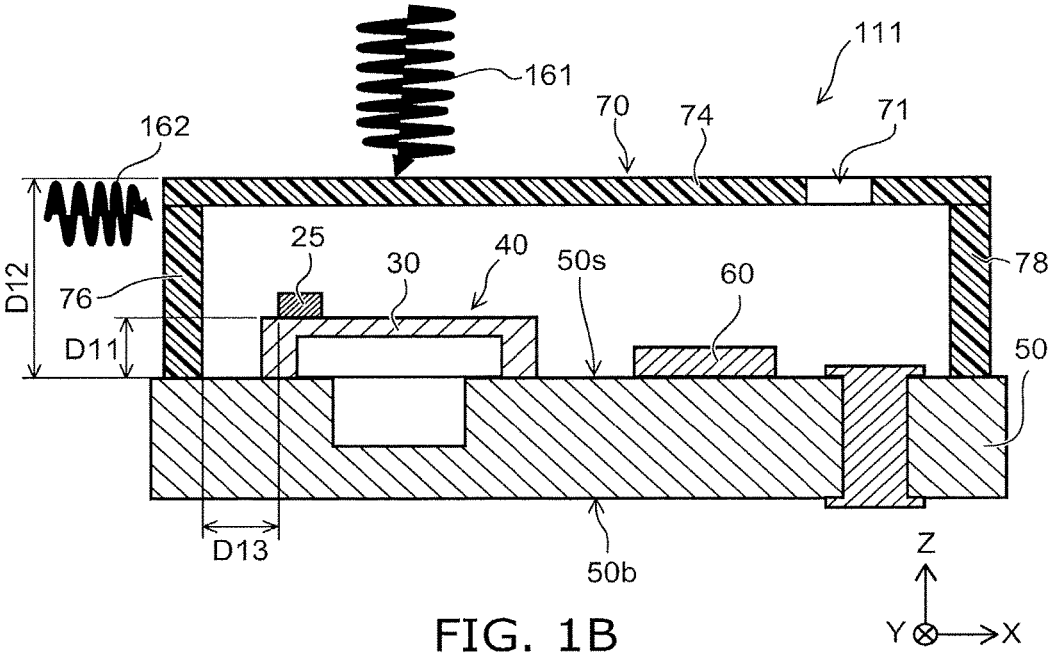

FIGS. 1A and 1B are schematic views illustrating the configuration of a microphone package according to a first embodiment.

FIG. 1A is a schematic plan view. FIG. 1B is a sectional view taken along line E1-E2 of FIG. 1A.

Figure 2A:
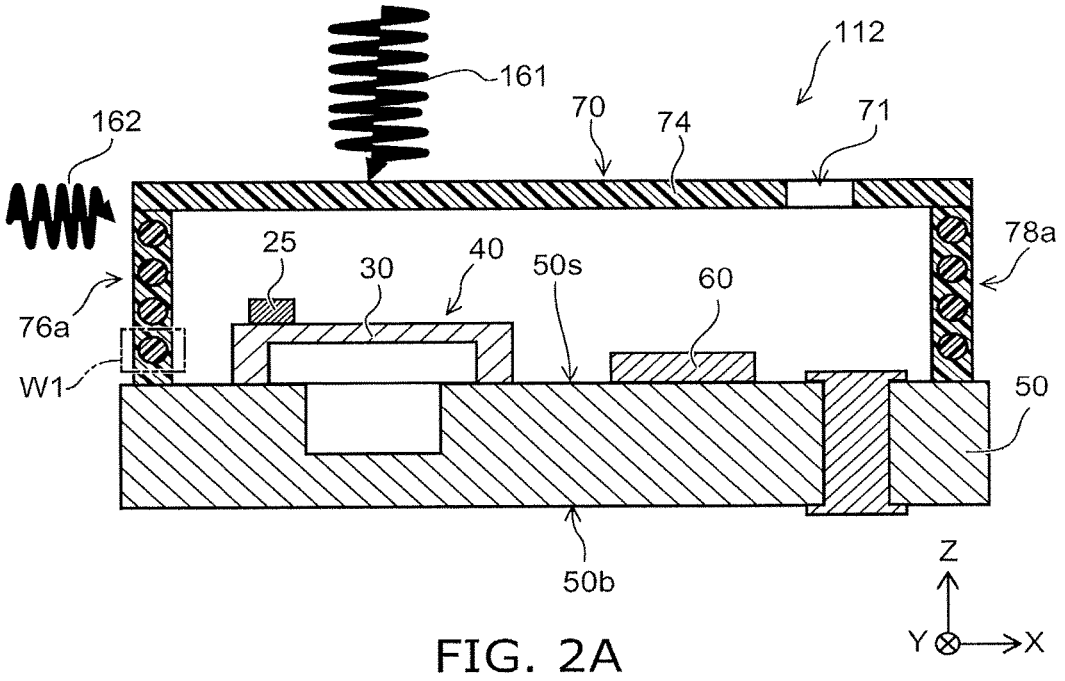
FIGS. 2A and 2B are schematic views illustrating the configuration of a microphone package according to a second embodiment.
Figure 2B:
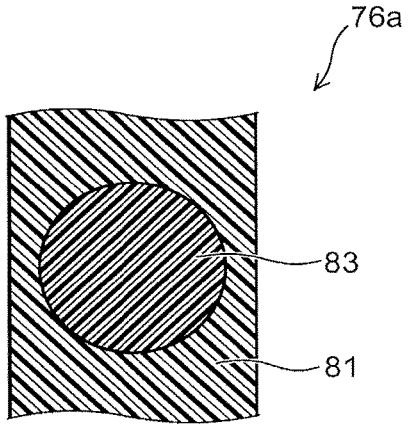

FIGS. 2A and 2B are schematic views illustrating the configuration of a microphone package according to a second embodiment.

FIG. 2A is a sectional view corresponding to the sectional view taken along line E1-E2 of FIG. 1A. FIG. 2B is a schematic enlarged view of region W1 shown in FIG. 2A.

Figure 3A:
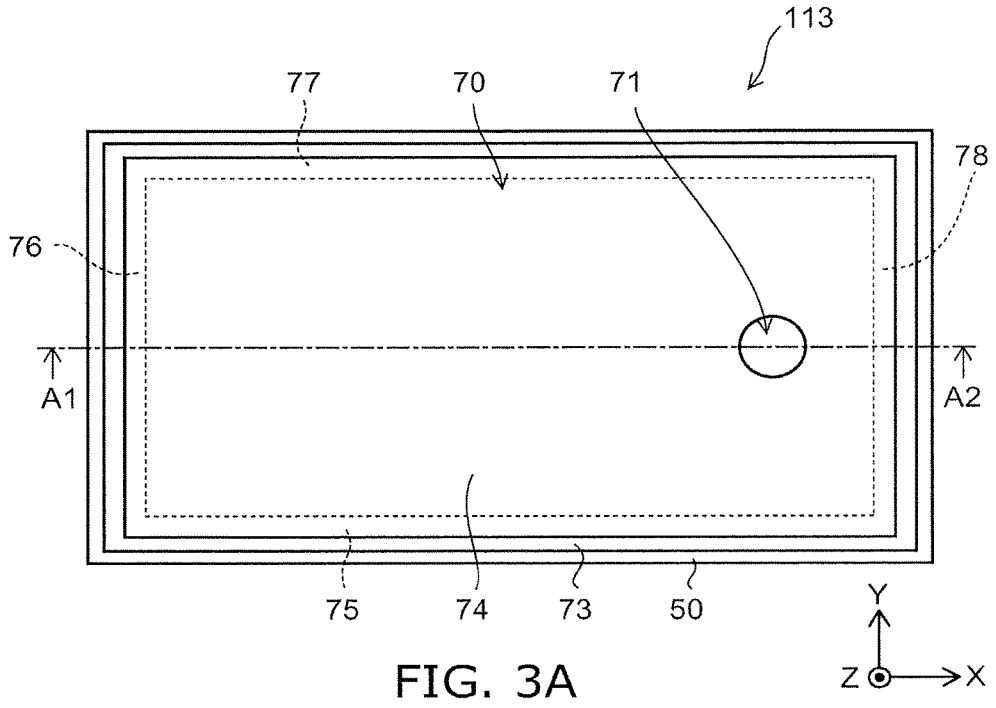
FIGS. 3A and 3B are schematic views illustrating the configuration of a microphone package according to a third embodiment.
Figure 3B:
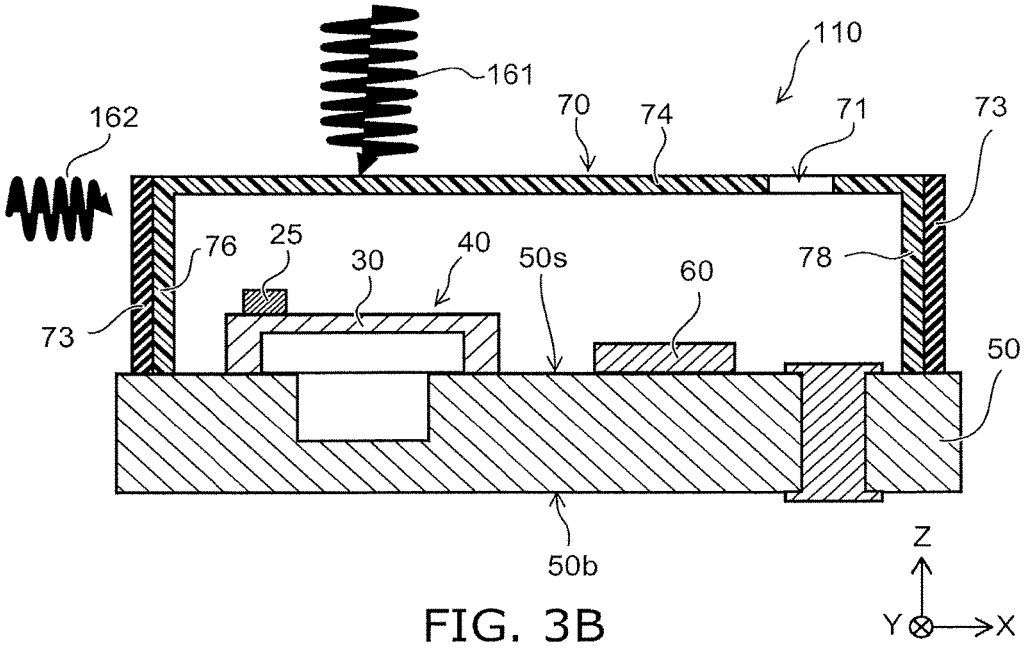

FIGS. 3A and 3B are schematic views illustrating the configuration of a microphone package according to a third embodiment.

FIG. 3A is a schematic plan view. FIG. 3B is a sectional view taken along line A1-A2 of FIG. 3A.

Figure 4A:
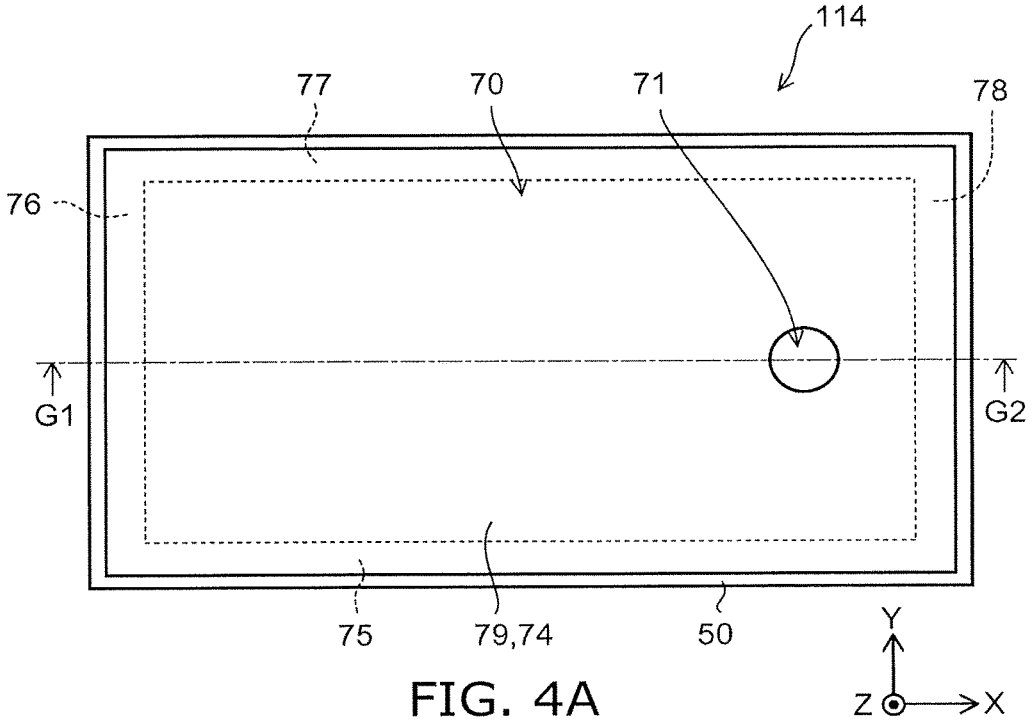
FIGS. 4A and 4B are schematic views illustrating the configuration of a microphone package according to a fourth embodiment.
Figure 4B:
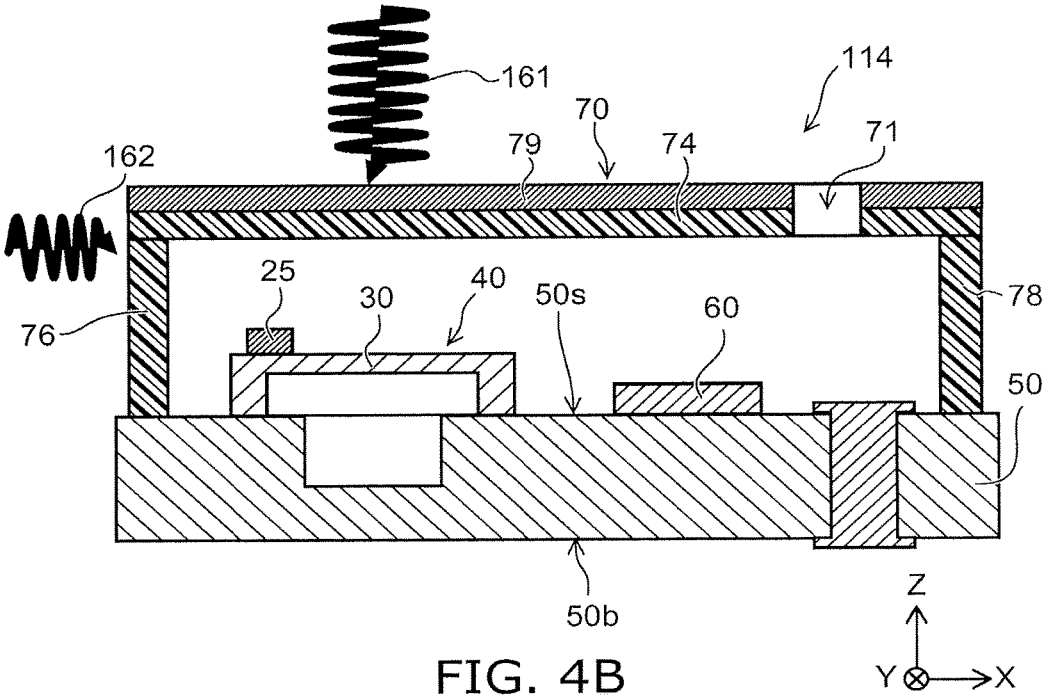

FIGS. 4A and 4B are schematic views illustrating the configuration of a microphone package according to a fourth embodiment.

FIG. 4A is a schematic plan view. FIG. 4B is a sectional view taken along line G1-G2 of FIG. 4A.

The microphone packages 111, 112, 113 according to the embodiments are applicable to e.g. a sound pressure sensor.

The microphone package 111 shown in FIGS. 1A and 1B includes a mounting substrate 50, a pressure sensing element 40, an application specific integrated circuit (ASIC) 60, and a cover 70.

The mounting substrate 50 has a first major surface 50*s* and a second major surface 50*b*.

The direction perpendicular to the first major surface 50*s* is referred to as Z-axis direction. One direction perpendicular to the Z-axis direction is referred to as X-axis direction. The direction perpendicular to the Z-axis direction and the X-axis direction is referred to as Y-axis direction. The second major surface 50*b* is spaced from the first major surface 50*s* in the Z-axis direction.

The pressure sensing element 40 is provided on the first major surface 50*s*. The pressure sensing element 40 includes a film 30 and a device 25. The integrated circuit 60 is provided on the first major surface 50*s*. The cover 70 is provided on the first major surface 50*s* and houses therein the pressure sensing element 40 and the integrated circuit 60. The mounting substrate 50 is provided with an electrode pad. The electrode pad will be described later.

In this specification, the state of being "provided on" includes not only the state of being provided in direct contact, but also the state of being provided with another element interposed in between.

The cover 70 has an upper portion (lid portion) 74, a first side portion 75, a second side portion 76, a third side portion 77, and a fourth side portion 78. The upper portion 74 has a surface substantially perpendicular to the Z-axis direction. The first side portion 75 has a surface non-parallel to the direction perpendicular to the Z-axis direction. In this example, the first side portion 75 has a surface substantially perpendicular to the direction perpendicular to the Z-axis direction. In other words, the first side portion 75 has a surface substantially parallel to the Z-axis direction. The second side portion 76 has a surface non-parallel to the direction perpendicular to the Z-axis direction. In this example, the second side portion 76 has a surface substantially perpendicular to the direction perpendicular to the Z-axis direction. In other words, the second side portion 76 has a surface substantially parallel to the Z-axis direction. The third side portion 77 has a surface non-parallel to the direction perpendicular to the Z-axis direction. In this example, the third side portion 77 has a surface substantially perpendicular to the direction perpendicular to the Z-axis direction. In other words, the third side portion 77 has a surface substantially parallel to the Z-axis direction. The fourth side portion 78 has a surface non-parallel to the direction perpendicular to the Z-axis direction. In this example, the fourth side portion 78 has a surface substantially perpendicular to the direction perpendicular to the Z-axis direction. In other words, the fourth side portion 78 has a surface substantially parallel to the Z-axis direction. The first side portion 75 is opposed to the third side portion 77. The second side portion 76 is opposed to the fourth side portion 78.

In this specification, the state of being "opposed" includes not only the state of directly facing, but also being indirectly opposed to each other with another element interposed in between.

The cover 70 has a sound hole 71. The sound hole 71 is provided in the upper portion 74 and penetrates through the upper portion 74. The sound hole 71 passes sound. For instance, the sound hole 71 transmits at least the sound outside the microphone package 111, 112, 113 to the inside of the microphone package 111, 112, 113 (inside of the cover 70). For instance, the sound hole 71 causes at least the sound outside the microphone package 111, 112, 113 to flow (travel) into the inside of the microphone package 111, 112, 113 (inside of the cover 70).

In the microphone package 111 shown in FIG. 1A, the first side portion 75, the second side portion 76, the third side portion 77, and the fourth side portion 78 are each formed of a magnetic body.

Alternatively, as in the microphone package 112 shown in FIG. 2A, the second side portion 76*a* and the fourth side portion 78*a* may be each formed of a non-magnetic body including magnetic particles (magnetic beads). That is, as shown in FIG. 2B, the second side portion 76*a* includes a non-magnetic body 81 and magnetic beads 83. The fourth side portion 78*a* includes a non-magnetic body 81 and magnetic beads 83. The non-magnetic body 81 is formed of e.g. a resin material (nonconductor). The magnetic bead 83 is made of e.g. nickel (Ni), iron (Fe), cobalt (Co), nickel oxide, iron oxide, cobalt oxide, nickel nitride, iron nitride, or cobalt nitride.

The second side portion 76*a* can be manufactured by e.g. the following method. First, magnetic beads 83 are mixed into a precured resin material (non-magnetic body 81 before curing). Then, the precured resin material including the magnetic beads 83 is poured into a mold and cured. The example of the method for manufacturing the second side portion 76*a* is similarly applied to the method for manufacturing the fourth side portion 78*a*.

The first side portion and the third side portion not shown in FIG. 2A are similar to the second side portion 76*a* or the fourth side portion 78*a* described above.

Alternatively, as in the microphone package 113 shown in FIGS. 3A and 3B, the first side portion 75, the second side portion 76, the third side portion 77, and the fourth side portion 78 may be each formed of a non-magnetic body, and then a magnetic body 73 may be added on the sidewall.

The microphone package 113 shown in FIGS. 3A and 3B is now further described.

The cover 70 includes a magnetic body 73. The magnetic body 73 is provided on the first side portion 75, the second side portion 76, the third side portion 77, and the fourth side portion 78. The magnetic body 73 is made of a magnetic body. The magnetic body 73 has a magnetic layer. The method for forming a magnetic body 73 on the side portion (first side portion 75, second side portion 76, third side portion 77, and fourth side portion 78) of the cover 70 can be based on e.g. sputtering technique, CVD technique, or electrolytic/electroless plating technique.

The first side portion 75, the second side portion 76, 76*a*, the third side portion 77, and the fourth side portion 78, 78*a* are made of a non-magnetic body. The magnetic body 73 is made of a magnetic body. The material of the magnetic body can be e.g. NiFe alloy, Ni—Fe—X alloy (X being Cu, Cr, Ta, Rh, Pt, or Nb), CoZrNb alloy, and FeAlSi alloy. Alternatively, the material of the magnetic body can be e.g. a ferrite material such as $FeO_3$ or $Fe_2O_3$.

The portion of the cover 70 other than the magnetic body 73 (upper portion 74, first side portion 75, second side portion 76, third side portion 77, and fourth side portion 78: base material) is made of a resin material. The base material of the cover 70 has a nonconductor layer. The base material of the cover 70 is e.g. at least one of phenol resin (PF), epoxy resin (EP), melamine resin (MF), urea resin (UF), unsaturated polyester resin (UP), alkyd resin polyurethane (PUR), thermosetting polyimide (PI), polyethylene (PE), high-density polyethylene (HDPE), medium-density polyethylene (MDPE), low-density polyethylene (LDPE), polypropylene (PP), polyvinyl chloride (PVC), polyvinylidene chloride, polystyrene (PS), polyvinyl acetate (PVAc), Teflon® (polytetrafluoroethylene, PTFE), ABS resin (acrylonitrile butadiene styrene resin), AS resin, acryl resin (PMMA), polyamide (PA) nylon, polyacetal (POM), polycarbonate (PC), modified polyphenylene ether (m-PPE, modified PPE, PPO), polybutylene terephthalate (PBT), polyethylene terephthalate (PET), glass fiber reinforced polyethylene terephthalate (GF-PET), cyclic polyolefin (COP), polyphenylene sulfide (PPS), polytetrafluoroethylene (PTFE), polysulfone (PSF), polyether sulfone (PES), noncrystalline polyarylate (PAR), polyether ether ketone (PEEK), thermoplastic polyimide (PI), and polyamide-imide (PAI).

The resin material can suppress the reflection of sound waves compared with the metal material. That is, the sound wave injected from the sound hole 71 into the microphone package 113 is reflected at other than the pressure sensing element 40. The sound wave is reflected by fixed end reflection. Thus, the sound wave experiences a phase shift. If the sound wave experiences a phase shift, the sound wave reflected at other than the pressure sensing element 40 interferes with the sound wave injected from the sound hole 71 into the microphone package 113. Thus, in the cover 70, improvement of acoustic performance is expected. In the embodiments, the surface area of the base material (resin material) of the cover 70 is larger than the surface area of the magnetic body. Thus, further improvement of acoustic performance is expected. The elasticity of the resin material is higher than the elasticity of the metal material. Thus, in the cover 70, improvement of mechanical robustness is expected. The shape workability of the resin material is higher than the shape workability of the metal material. Thus, performance improvement of the microphone package 111, 112, 113 is expected.

In the microphone package 114 shown in FIGS. 4A and 4B, a lid body 79 formed of e.g. metal is provided on the upper portion 74 of the cover 70. In such a case, sound waves transmitted through the upper portion 74 of the cover 70 can be suppressed. The hardness of the lid body 79 is harder than the hardness of the upper portion 74 formed of a resin material. Thus, the resonance design can be performed more easily by taking into consideration only the sound injected from the sound hole 71 into the microphone package 114. The hardness of the lid body 79 and the upper portion 74 can be measured by e.g. at least one of the test methods for Brinell hardness, Vickers hardness, Rockwell hardness, durometer hardness, Barcol hardness, and monotron hardness.

Figure 5:
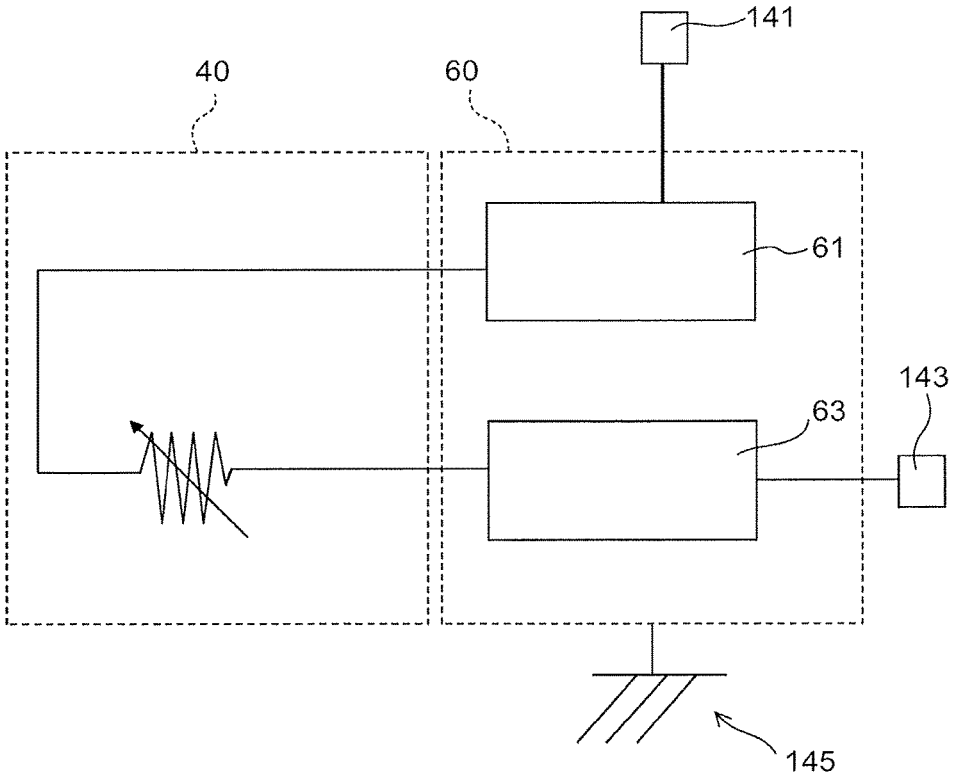
FIG. 5 is a block diagram illustrating the main configuration of an electric circuit of the microphone package according to the embodiments.

FIG. 5 is a block diagram illustrating the main configuration of an electric circuit of the microphone package according to the embodiments.

The integrated circuit 60 includes a driving circuit 61 and a signal processing circuit 63. The driving circuit 61 is installed on the first major surface 50*s* of the mounting substrate 50. The signal processing circuit 63 is installed on the first major surface 50*s* of the mounting substrate 50. The mounting substrate 50 is formed like e.g. a rectangular plate. The mounting substrate 50 includes a wiring pattern. The driving circuit 61 supplies a prescribed voltage or current to the pressure sensing element 40. The signal processing circuit 63 amplifies the output of the pressure sensing element 40.

An external power supply 141 is connected to the input side of the driving circuit 61. When the external power supply 141 supplies a voltage or current to the driving circuit 61, the driving circuit 61 is operated and generates an electrical signal required to drive the pressure sensing element 40. The output side of the driving circuit 61 is connected to the input side of the pressure sensing element 40. When the electrical signal generated by the driving circuit 61 is inputted to the pressure sensing element 40, the pressure sensing element 40 is driven. When the pressure sensing element 40 is driven, an electrical signal is outputted to the output side of the pressure sensing element 40. The output side of the pressure sensing element is connected to the input side of the signal processing circuit 63. When the signal processing circuit 63 has processed a sensing signal, an electrical signal is outputted to the output side of the signal processing circuit 63. The output side of the signal processing circuit 63 is connected to an output terminal 143. The electrical signal of the signal processing circuit 63 is outputted through the output terminal 143 to the outside of the microphone module. The integrated circuit 60 is provided with a ground 145. That is, the integrated circuit 60 is grounded.

FIGS. 6A to 7B are schematic views illustrating the influence of the direction of the external magnetic field.

Figure 6A:
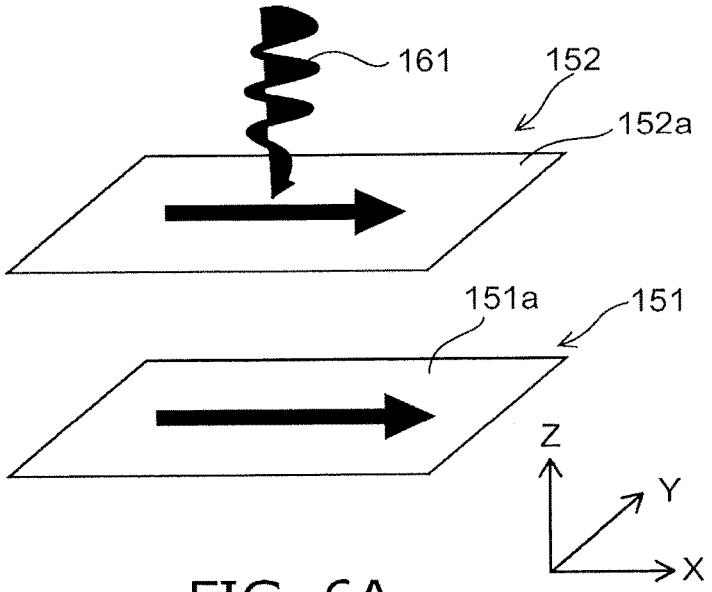
FIGS. 6A and 6B are schematic views illustrating the influence of the direction of the external magnetic field.
Figure 6B:
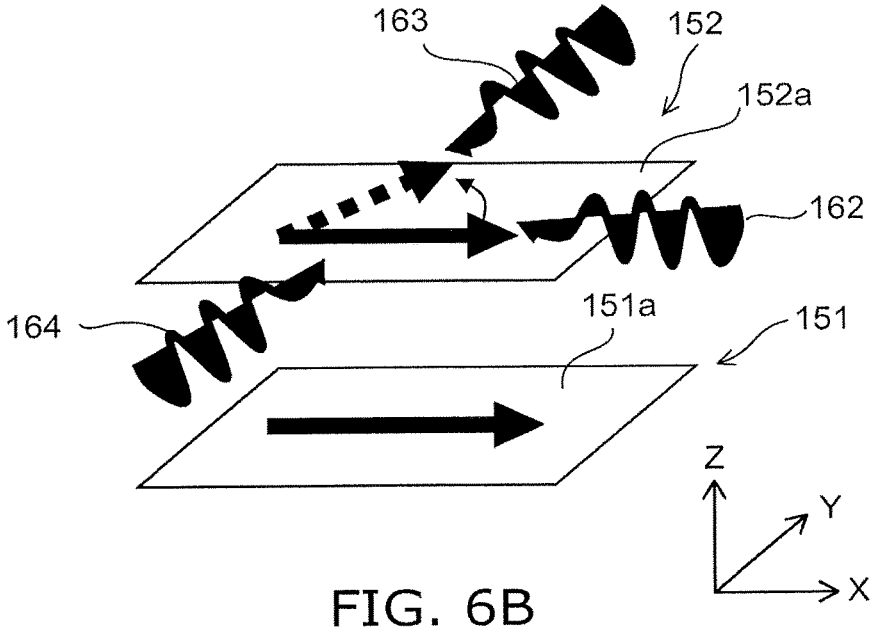
Figure 7A:
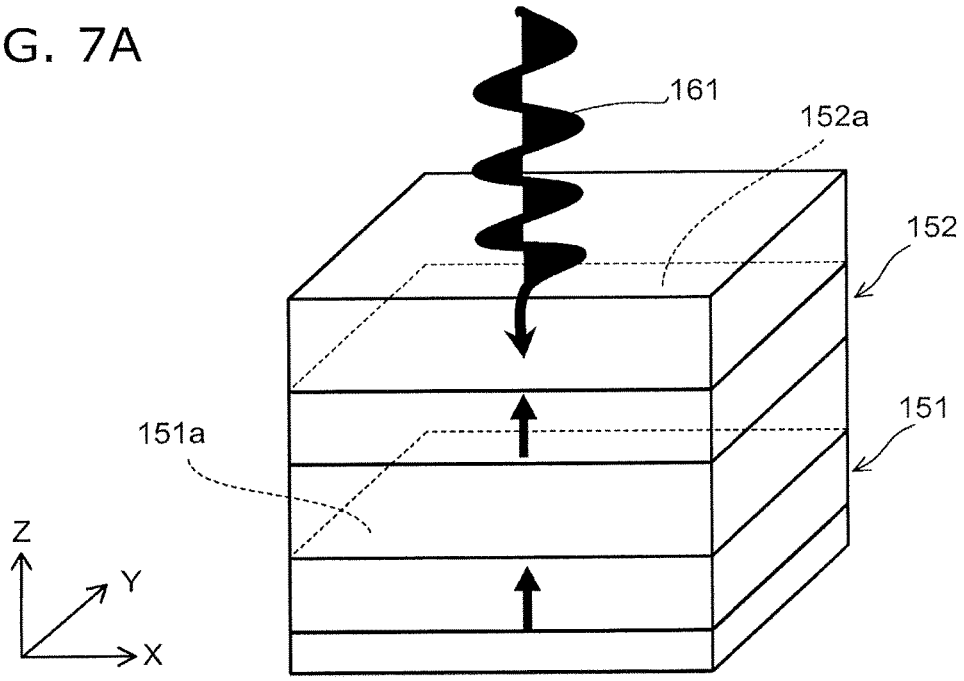
FIGS. 7A and 7B are schematic views illustrating the influence of the direction of the external magnetic field.
Figure 7B:
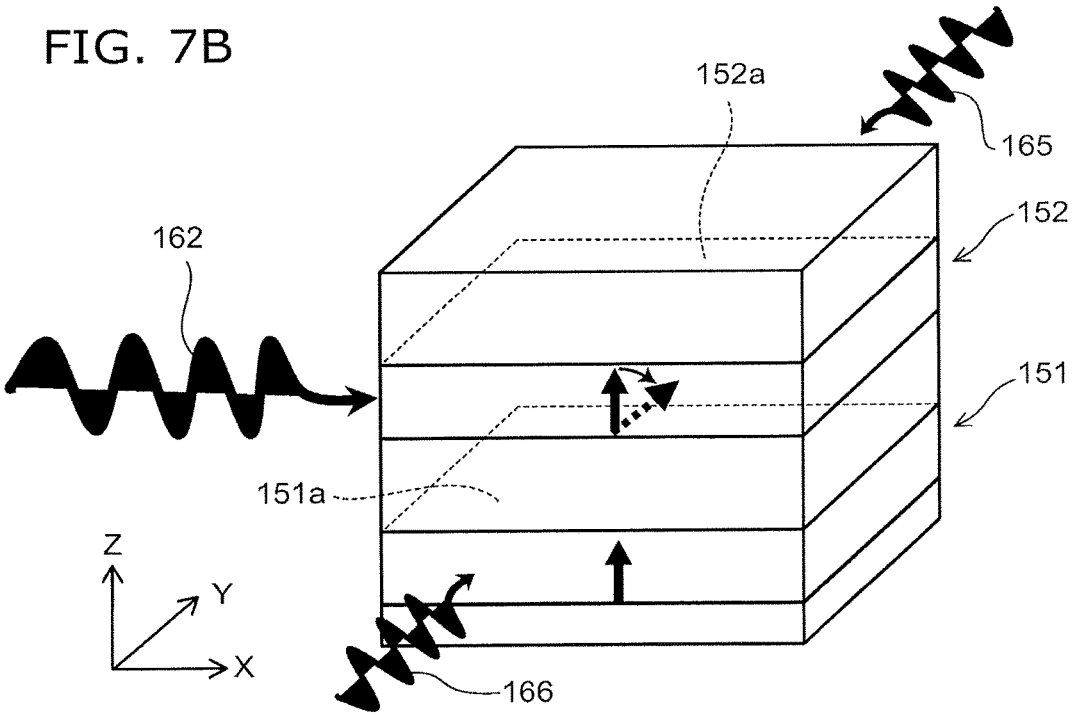

FIGS. 6A and 7A are schematic perspective views illustrating the case where an external magnetic field with the component perpendicular to the major surface of the magnetic layer acts on the magnetization of the magnetic layer. FIGS. 6B and 7B are schematic perspective views illustrating the case where an external magnetic field with the component parallel to the major surface of the magnetic layer acts on the magnetization of the magnetic layer.

The pressure sensing element 40 includes e.g. a spin valve film formed of a stacked film of ultrathin magnetic films. The resistance of the spin valve film is changed by an external magnetic field. The amount of change of the resistance is the MR rate of change. The MR phenomenon results from various physical effects. The MR phenomenon is based on e.g. the giant magnetoresistive (GMR) effect or the tunneling magnetoresistive (TMR) effect.

The spin valve film has a configuration in which at least two ferromagnetic layers are stacked via a spacer layer. The magnetoresistive state of the spin valve film is determined by the relative angle between the magnetization directions of the two ferromagnetic layers. For instance, when the magnetizations of the two ferromagnetic layers are mutually in the parallel state, the spin valve film is in a low resistance state. When the magnetizations are in the antiparallel state, the spin valve film is in a high resistance state. When the angle between the magnetizations of the two ferromagnetic layers is an intermediate angle, an intermediate resistance state is obtained.

Of the at least two magnetic layers, the magnetic layer in which the magnetization is easily rotated is e.g. a magnetization free layer (second magnetic layer) 152. The magnetization free layer 152 has a major surface 152*a*. The magnetic layer in which the magnetization is changed less easily is a reference layer (first magnetic layer) 151. The reference layer 151 has a major surface 151*a*.

The magnetization direction of the magnetic layer is changed also by an external stress. By using this phenomenon, the spin valve film can be used as a strain sensing element or pressure sensing element. The change of the magnetization (second magnetization) of the magnetization free layer 152 due to strain is based on e.g. the inverse magnetostriction effect.

The magnetostriction effect is the phenomenon in which the strain of a magnetic material is changed when the magnetization of the magnetic material is changed. The magnitude of the strain is changed depending on the magnitude and direction of the magnetization. The magnitude of the strain can be controlled through these parameters of the magnitude and direction of the magnetization. The amount of change of the strain at which the amount of strain is saturated with the increase in the intensity of the applied magnetic field is the magnetostriction constant $\lambda s$. The magnetostriction constant depends on the intrinsic characteristics of the magnetic material. The magnetostriction constant ($\lambda s$) indicates the magnitude of the shape change of the magnetic layer subjected to saturated magnetization in a direction under application of an external magnetic field. The length in the state of no external magnetic field is denoted by L. If the length is changed by ΔL under application of an external magnetic field, the magnetostriction constant λs is represented by ΔL/L. This amount of change is changed with the magnitude of the external magnetic field. However, the magnetostriction constant λs is defined by ΔL/L for the state in which the magnetization is saturated under application of a sufficient external magnetic field. In the embodiments, the absolute value of the magnetostriction constant λs is preferably $10^{-5}$ or more. Then, strain is efficiently produced by stress, and the sensing sensitivity of pressure is enhanced. The absolute value of the magnetostriction constant is e.g. $10^{-2}$ or less. This value is an upper limit for practical materials causing the magnetostriction effect.

As a phenomenon opposite to the magnetostriction effect, the inverse magnetostriction effect is known. In the inverse magnetostriction effect, when an external stress is applied, the magnetization of the magnetic material is changed. The magnitude of this change depends on the magnitude of the external stress and the magnetostriction constant of the magnetic material. The magnetostriction effect and the inverse magnetostriction effect are physically symmetric to each other. Thus, the magnetostriction constant of the inverse magnetostriction effect is equal to the magnetostriction constant of the magnetostriction effect.

The magnetostriction effect and the inverse magnetostriction effect are associated with a positive magnetostriction constant or a negative magnetostriction constant. These constants depend on the magnetic material. In the case of a material having a positive magnetostriction constant, the magnetization is changed so as to be directed along the direction of application of a tensile strain. In the case of a material having a negative magnetostriction constant, the magnetization is changed so as to be directed along the direction of application of a compressive strain.

By the inverse magnetostriction effect, the magnetization direction of the magnetization free layer 152 of the spin valve film can be changed. When an external stress is applied, the magnetization direction of the magnetization free layer 152 is changed by the inverse magnetostriction effect. This causes a difference in the relative magnetization angle between the reference layer 151 and the magnetization free layer 152. Thus, the resistance of the spin valve film is changed. Accordingly, the spin valve film can be used as a strain sensing element.

The strain sensing element is formed on e.g. a "membrane". The membrane plays a role like an eardrum for converting pressure to strain. The strain sensing element formed on the membrane reads the strain to enable pressure sensing. The membrane is e.g. a monocrystalline Si substrate. Etching is performed from the rear surface of the monocrystalline Si substrate to thin the portion where the strain sensing element is placed. Thus, a diaphragm is formed. The diaphragm is deformed in response to the applied pressure.

For instance, the shape of the first major surface of the diaphragm projected on the X-Y plane can be geometrically isotropic. Then, around the geometric center point, the strain caused by the diaphragm displacement has a fixed value on the X-Y plane. Thus, if the strain sensing element is placed at the geometric center point of the diaphragm, the strain causing the rotation of magnetization is made isotropic. Accordingly, there occurs no rotation of magnetization of the magnetic layer, and there also occurs no change in the resistance of the device. Thus, in the embodiments, preferably, the strain sensing element is not placed at the geometric center point of the diaphragm. For instance, if the shape of the diaphragm projected on the X-Y plane is circular, the maximum anisotropic strain occurs near the outer periphery of the circular shape by the diaphragm displacement. Thus, if the strain sensing element is placed near the outer periphery of the diaphragm, the sensitivity of the pressure sensing element 40 is enhanced.

In the embodiments, the membrane can be made of e.g. Si. Alternatively, the membrane is a flexible substrate made of a material easy to bend. The flexible substrate is made of e.g. a polymer material. The polymer material can be e.g. at least one of acrylonitrile butadiene styrene, cycloolefin polymer, ethylene propylene, polyamide, polyamide-imide, polybenzyl imidazole, polybutylene terephthalate, polycarbonate, polyethylene, polyethylene ether ketone, polyethylimide, polyethyleneimine, polyethylene naphthalene, polyester, polysulfone, polyethylene terephthalate, phenol formaldehyde, polyimide, polymethyl methacrylate, polymethylpentene, polyoxymethylene, polypropylene, m-phenyl ether, poly-p-phenyl sulfide, p-amide, polystyrene, polysulfone, polyvinyl chloride, polytetrafluoroethene, perfluoroalkoxy, ethylene propylene fluoride, polytetrafluoroethene, polyethylene tetrafluoroethylene, polyethylene chlorotrifluoroethylene, polyvinylidene fluoride, melamine formaldehyde, liquid crystalline polymer, and urea formaldehyde.

As described with reference to FIG. 5, the pressure sensing element 40 is connected to the driving circuit 61 of the integrated circuit 60 installed on the mounting substrate 50. When the electrical signal generated by the driving circuit 61 is inputted to the pressure sensing element 40, the pressure sensing element 40 is driven.

When the diaphragm is strained in response to the sound pressure of a sound, the pressure sensing element 40 extracts the change of the voltage in proportion to the change of the resistance of the strain sensing element placed on the diaphragm. The pressure sensing element 40 is a sound signal change element for converting a sound signal to a voltage signal for output. The output signal of the pressure sensing element 40 has a relatively low level. Thus, the output side of the pressure sensing element 40 is connected to an amplifier (e.g., signal processing circuit 63). Accordingly, the output signal of the pressure sensing element 40 representing the sound signal is amplified.

Because the output signal of the pressure sensing element 40 has a relatively low level, the output signal of the pressure sensing element 40 is vulnerable to external noise. The resistance of the spin valve film of the pressure sensing element 40 is changed by an external magnetic field. Thus, the external magnetic field due to e.g. geomagnetism may act as external noise on at least one of the magnetization of the magnetization free layer 152 and the magnetization (first magnetization) of the reference layer 151.

That is, as shown in FIGS. 6A and 6B, in an example of the microphone package 111, 112, 113, 114 according to the embodiments, the direction of the magnetization of the magnetization free layer 152 and the direction of the magnetization of the reference layer 151 are each parallel to the X-Y plane. Namely, the direction of the magnetization of the magnetization free layer 152 is parallel to the major surface 152*a* of the magnetization free layer 152. The direction of the magnetization of the reference layer 151 is parallel to the major surface 151*a* of the reference layer 151. In other words, the direction of the magnetization of the magnetization free layer 152 is perpendicular to the Z-axis direction (stacking direction). The direction of the magnetization of the reference layer 151 is perpendicular to the Z-axis direction (stacking direction). The configuration using this state is referred to as "in-plane magnetization scheme". In the in-plane magnetization scheme, the pressure sensing element 40 senses pressure change based on the change of the angle between the direction of the magnetization of the reference layer 151 and the direction of the magnetization of the magnetization free layer 152. Thus, the external magnetic field due to e.g. geomagnetism may act as external noise on at least one of the magnetization of the magnetization free layer 152 and the magnetization of the reference layer 151.

On the other hand, as shown in FIGS. 7A and 7B, in an alternative example of the microphone package 111, 112, 113, 114 according to the embodiments, the direction of the magnetization of the magnetization free layer 152 and the direction of the magnetization of the reference layer 151 are each perpendicular to the X-Y plane. Namely, the direction of the magnetization of the magnetization free layer 152 is perpendicular to the major surface 152*a* of the magnetization free layer 152. The direction of the magnetization of the reference layer 151 is perpendicular to the major surface 151*a* of the reference layer 151. In other words, the direction of the magnetization of the magnetization free layer 152 is parallel to the Z-axis direction (stacking direction). The direction of the magnetization of the reference layer 151 is parallel to the Z-axis direction (stacking direction). The configuration using this state is referred to as "perpendicular magnetization scheme". In the perpendicular magnetization scheme, the pressure sensing element 40 senses pressure change based on the change of the angle between the direction of the magnetization of the reference layer 151 and the direction of the magnetization of the magnetization free layer 152. Thus, the external magnetic field due to e.g. geomagnetism may act as external noise on at least one of the magnetization of the magnetization free layer 152 and the magnetization of the reference layer 151.

As shown in FIGS. 6A and 7A, the first external magnetic field 161 with the component perpendicular to the major surface 152*a* of the magnetization free layer 152 does not act on the magnetization of the magnetization free layer 152 as a force for rotating the magnetization of the magnetization free layer 152.

On the other hand, as shown in FIGS. 6B and 7B, the second external magnetic field 162 with the component parallel to the major surface 152*a* of the magnetization free layer 152 acts on the magnetization of the magnetization free layer 152 as a force for rotating the magnetization of the magnetization free layer 152. Then, the resistance of the spin valve film may be changed. Thus, the external magnetic field may appear as external noise in the output signal of the pressure sensing element 40. Here, for instance, the third external magnetic field 163 and the fourth external magnetic field 164 shown in FIG. 6B are not parallel to the magnetization of the magnetization free layer 152, but have a component parallel to the major surface 152*a* of the magnetization free layer 152. Thus, the third external magnetic field 163 and the fourth external magnetic field 164 act on the magnetization of the magnetization free layer 152 as a force for rotating the magnetization of the magnetization free layer 152. For instance, the fifth external magnetic field 165 and the sixth external magnetic field 166 shown in FIG. 7B, like the second external magnetic field 162, act on the magnetization of the magnetization free layer 152 as a force for rotating the magnetization of the magnetization free layer 152.

In contrast, in the microphone package 111 shown in FIGS. 1A and 1B, the first side portion 75, the second side portion 76, the third side portion 77, and the fourth side portion 78 are each formed of a magnetic body. In the microphone package 112 shown in FIGS. 2A and 2B, the first side portion, the second side portion 76*a*, the third side portion, and the fourth side portion 78*a* are each formed of a non-magnetic body 81 including magnetic beads 83. In the microphone package 113 shown in FIGS. 3A and 3B, a magnetic body 73 is provided on the first side portion 75, the second side portion 76, the third side portion 77, and the fourth side portion 78. The magnetic body 73 forms a magnetic closed circuit. The magnetic body 73 may have e.g. a slit as long as the magnetic field is continuous.

The first side portion 75, the second side portion 76, 76*a*, the third side portion 77, and the fourth side portion 78, 78*a* are each non-parallel to the major surface 152*a* of the magnetization free layer 152. Alternatively, the absolute value of the angle between the major surface 152*a* of the magnetization free layer 152 and each of the plane including the first side portion 75, the plane including the second side portion 76, 76*a*, the plane including the third side portion 77, and the plane including the fourth side portion 78, 78*a* is 45 degrees or more. Alternatively, the absolute value of the angle between the major surface 152*a* of the magnetization free layer 152 and each of the plane including the first side portion 75, the plane including the second side portion 76, 76*a*, the plane including the third side portion 77, and the plane including the fourth side portion 78, 78*a* is 85 degrees or more.

In other words, the first side portion 75, the second side portion 76, 76*a*, the third side portion 77, and the fourth side portion 78, 78*a* are non-parallel to the direction perpendicular to the stacking direction. Alternatively, the absolute value of the angle between the stacking direction and each of the plane including the first side portion 75, the plane including the second side portion 76, 76*a*, the plane including the third side portion 77, and the plane including the fourth side portion 78, 78*a* is less than 45 degrees. Alternatively, the absolute value of the angle between the stacking direction and each of the plane including the first side portion 75, the plane including the second side portion 76, 76*a*, the plane including the third side portion 77, and the plane including the fourth side portion 78, 78*a* is 5 degrees or less.

That is, the first side portion 75, the second side portion 76, 76*a*, the third side portion 77, and the fourth side portion 78, 78*a* are placed depending on the direction of the magnetization of the reference layer 151 and the direction of the magnetization of the magnetization free layer 152. Specifically, in the case of the in-plane magnetization scheme, the first side portion 75, the second side portion 76, 76*a*, the third side portion 77, and the fourth side portion 78, 78*a* each have a surface substantially perpendicular to the direction of the magnetization of the reference layer 151 and the direction of the magnetization of the magnetization free layer 152. In the case of the perpendicular magnetization scheme, the first side portion 75, the second side portion 76, 76*a*, the third side portion 77, and the fourth side portion 78, 78*a* each have a surface substantially parallel to the direction of the magnetization of the reference layer 151 and the direction of the magnetization of the magnetization free layer 152.

In the microphone package 111 shown in FIGS. 1A and 1B, when the second external magnetic field 162 with the component parallel to the major surface 152*a* of the magnetization free layer 152 is applied, the magnetic flux passes through the magnetic closed circuit formed of the side portion formed of a magnetic body, the side portion being the side portion of the cover 70. In the microphone package 112 shown in FIG. 2A, when the second external magnetic field 162 with the component parallel to the major surface 152*a* of the magnetization free layer 152 is applied, the magnetic flux passes through the magnetic closed circuit formed of the side portion including magnetic beads 83, the side portion being the side portion of the cover 70. In the microphone package 113 shown in FIGS. 3A and 3B, when the second external magnetic field 162 with the component parallel to the major surface 152*a* of the magnetization free layer 152 is applied, the magnetic flux passes through the magnetic closed circuit formed of the magnetic body 73. In other words, the magnetic flux of the second external magnetic field 162 passes through at least one of the magnetic body 73 provided on the first side portion 75, the magnetic body 73 provided on the second side portion 76, the magnetic body 73 provided on the third side portion 77, and the magnetic body 73 provided on the fourth side portion 78.

Then, the magnetic flux of the second external magnetic field 162 does not penetrate into the cover 70. Thus, the side portion of the cover 70 blocks the second external magnetic field 162 with the component parallel to the major surface 152*a* of the magnetization free layer 152 from penetrating into the cover 70. Alternatively, the magnetic body 73 blocks the second external magnetic field 162 with the component parallel to the major surface 152*a* of the magnetization free layer 152 from penetrating into the cover 70. The pressure sensing element 40 inside the cover 70 is not exposed to the second external magnetic field 162 with the component parallel to the major surface 152*a* of the magnetization free layer 152. This can suppress the external magnetic field acting as external noise on the magnetization of the magnetization free layer 152. That is, the rotation of the magnetization direction of the magnetization free layer 152 by the external magnetic field can be suppressed. Thus, a sound signal change element having relatively high SN ratio can be obtained.

As shown in FIG. 1B, the distance (height of the film 30) between the first major surface 50*s* and the upper surface of the film 30 is denoted by D11. The distance (height of the cover 70) between the first major surface 50*s* and the upper surface of the cover 70 is denoted by D12. The distance between the inner wall of the side portion (the second side portion 76 in the example of FIGS. 1A and 1B) of the cover 70 and the end portion of the device 25 is denoted by D13. Then, if $D13<|D12-D11|/\tan 45°=|D12-D11|$ is satisfied, penetration of the second external magnetic field 162 into the cover 70 can be blocked more effectively. That is, the blocking effect is more significant when the distance between the inner wall of the side portion of the cover 70 and the end portion of the device 25 is smaller than the absolute value of the difference between the distance (height of the cover 70) between the first major surface 50*s* and the upper surface of the cover 70 and the distance (height of the film 30) between the first major surface 50*s* and the upper surface of the film 30.

Here, the value "45°" refers to the angle at which the ratio of the component perpendicular to the inner wall or outer wall of the side portion (the second side portion 76 in the example of FIGS. 1A and 1B) of the cover 70 versus the component parallel to the inner wall or outer wall of the side portion (the second side portion 76 in the example of FIGS. 1A and 1B) of the cover is 1:1.

The integrated circuit 60 is spaced from the pressure sensing element 40 in the X-axis direction. Thus, the pressure sensing element 40 is placed in a region having a length of approximately half the length of the mounting substrate 50 in the X-axis direction.

For instance, in a capacitance microphone such as a condenser microphone, electromagnetic waves act as noise. Thus, the microphone package (e.g., the base material of the cover 70) is formed of metal. In contrast, in the pressure sensing element 40 according to the embodiments, electromagnetic waves do not act as noise. Thus, the base material of the cover 70 does not need to be formed of metal. The base material of the cover 70 can be formed of a resin material. Thus, as described with reference to FIGS. 1A and 1B, in the cover 70, improvement of acoustic performance is expected. In the cover 70, improvement of mechanical robustness is expected. Performance improvement of the microphone package 111, 112, 113 is expected.

As described above, a magnetic body (including magnetic beads) is placed on the side portion of the cover 70 provided depending on the direction of the magnetization of the reference layer 151 in the cover 70 and the direction of the magnetization of the magnetization free layer 152 in the cover 70. Thus, penetration of the second external magnetic field 162 into the cover 70 can be blocked more effectively. On the other hand, the remaining portion of the cover 70 can be made of a material advantageous to acoustic performance.

Figure 8A:
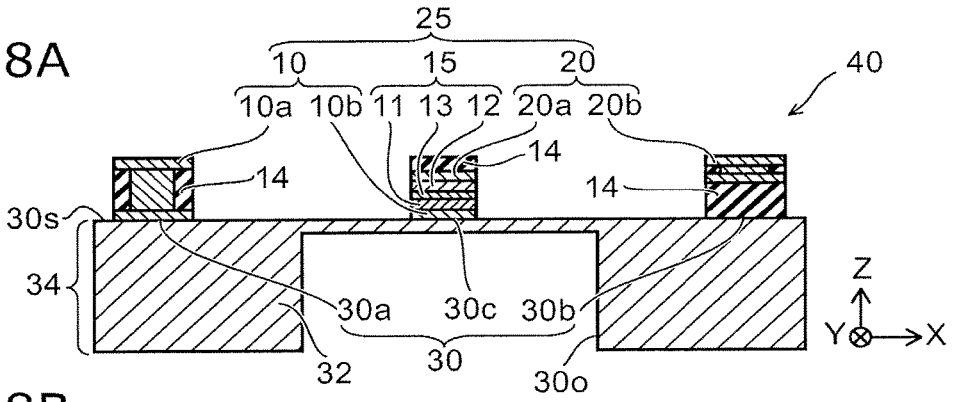
FIGS. 8A to 8C are schematic views illustrating the configuration of the pressure sensing element of the embodiments.
Figure 8B:
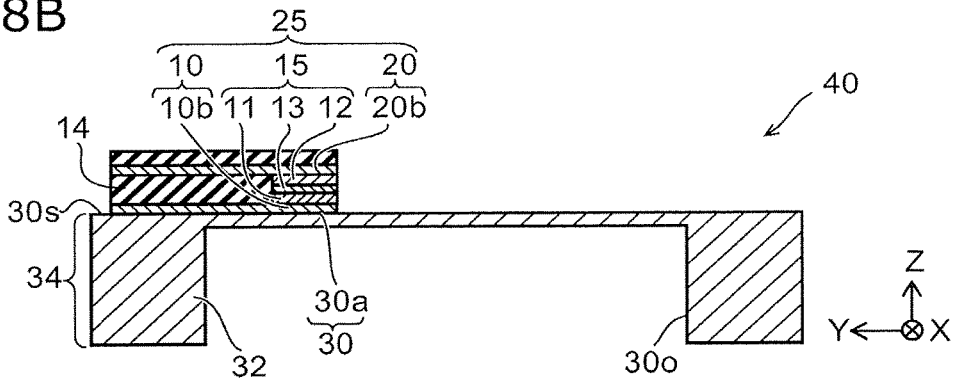
Figure 8C:
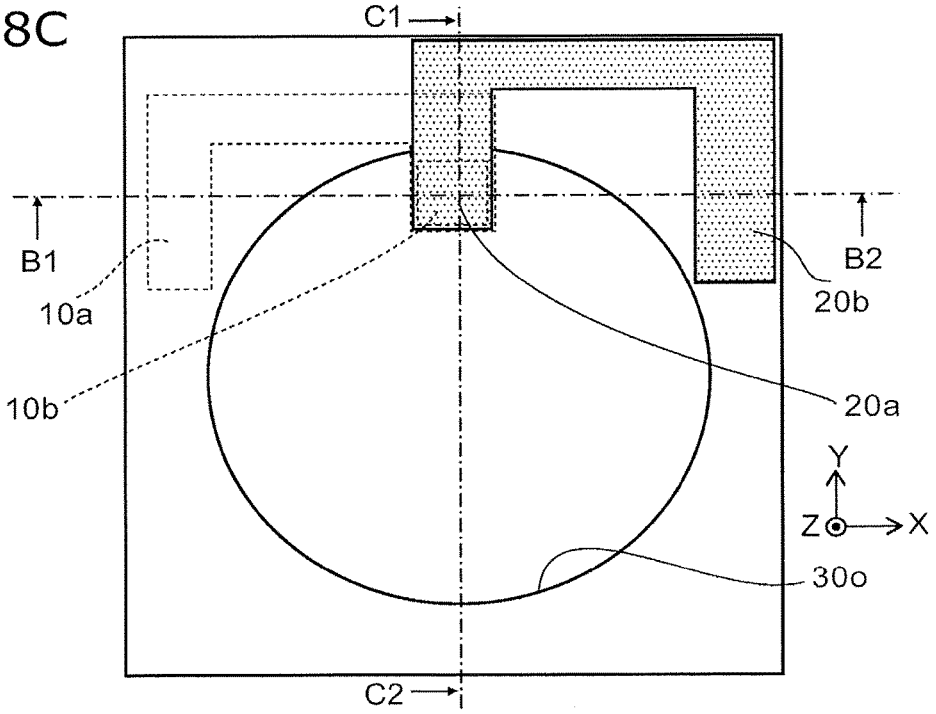

FIGS. 8A to 8C are schematic views illustrating the configuration of the pressure sensing element of the embodiments. FIG. 8C is a transparent plan view. FIG. 8A is a sectional view taken along line B1-B2 of FIG. 8C. FIG. 813 is a sectional view taken along line C1-C2 of FIG. 8C.

As shown in FIGS. 8A to 8C, the pressure sensing element 40 includes a film 30 and a device 25.

The film 30 has a first major surface 30*s*. The first major surface 30*s* has a first edge portion 30*a*, a second edge portion 30*b*, and an inside portion 30*c*. The second edge portion 30*b* is spaced from the first edge portion 30*a*. The inside portion 30*c* is located e.g. between the first edge portion 30*a* and the second edge portion 30*b*.

For instance, the pressure sensing element 40 includes a membrane 34. The membrane 34 corresponds to the film 30. A recess 30*o* is provided in part of the inside of the membrane 34. The shape of the recess 30*o* projected on the X-Y plane is e.g. a circle (including a flattened circle), or a polygon. The recess 30*o* of the membrane 34 (the thin portion of the membrane 34) constitutes the inside portion 30*c*. The periphery of the inside portion 30*c* (e.g., the portion of the membrane 34 thicker than the recess 300) constitutes outside portions. One of the outside portions constitutes the first edge portion 30*a*. Another of the outside portions constitutes the second edge portion 30*b*. The membrane 34 is made of e.g. silicon. However, the embodiments are not limited thereto, but the material of the membrane 34 is arbitrary.

In this example, the thickness of the outside portion of the membrane 34 is different from the thickness of the inside portion 30*c*. The embodiments are not limited thereto, but these thicknesses may be equal to each other. In this example, the shape of the membrane 34 is rectangular. However, the shape is arbitrary.

The device 25 is provided on the first major surface 30*s*. The device 25 includes a first electrode 10, a second electrode 20, a first magnetic layer 11, a second magnetic layer 12, and a non-magnetic layer 13.

The first electrode 10 has a first portion 10*a* and a second portion 10*b*. The first portion 10*a* is opposed to the first edge portion 30*a*. The second portion 10*b* is opposed to the inside portion 30*c*.

The second electrode 20 has a third portion 20*a* and a fourth portion 20*b*. The third portion 20*a* is opposed to the inside portion 30*c*. The fourth portion 20*b* is opposed to the second edge portion 30*b*. The fourth portion 20*b* does not overlap the first electrode 10 as projected on the X-Y plane (the plane parallel to the first major surface 30*s*).

The first magnetic layer 11 is provided between the second portion 10*b* and the third portion 20*a*.

The second magnetic layer 12 is provided between the first magnetic layer 11 and the third portion 20*a*.

The non-magnetic layer 13 is provided between the first magnetic layer 11 and the second magnetic layer 12.

The first magnetic layer 11, the non-magnetic layer 13, and the second magnetic layer 12 are stacked along the Z-axis direction (stacking direction).

In this specification, the state of being "stacked" includes not only the state of being stacked in contact with each other, but also the state of being stacked with another element interposed in between.

The first magnetic layer 11, the non-magnetic layer 13, and the second magnetic layer 12 constitute a strain sensing element 15. That is, the device 25 includes the first electrode 10, the second electrode 20, and the strain sensing element 15. In the pressure sensing element 40, in response to the strain of the film 30, the angle between the direction of the magnetization of the first magnetic layer 11 and the direction of the magnetization of the second magnetic layer 12 is changed. An example of the configuration and characteristics of the strain sensing element 15 will be described later.

An insulating layer 14 embedding the strain sensing element 15 is provided. The insulating layer 14 is made of e.g. $SiO_2$ or $Al_2O_3$.

In this example, on the inside portion 30*c*, the second portion 10*b* of the first electrode 10, the first magnetic layer 11, the non-magnetic layer 13, the second magnetic layer 12, and the third portion 20*a* of the second electrode 20 are provided in this order. That is, the second portion 10*b* is placed between the third portion 20*a* and the inside portion 30*c*. However, the embodiments are not limited thereto. The third portion 20*a* may be placed between the second portion 10*b* and the inside portion 30*c*.

The first magnetic layer 11 has a first magnetization. In the embodiments, the direction of the first magnetization is parallel to the X-Y plane. The second magnetic layer 12 has a second magnetization. In the embodiments, the direction of the second magnetization is parallel to the X-Y plane. In other words, the direction of the first magnetization is perpendicular to the Z-axis direction (stacking direction). The direction of the second magnetization is perpendicular to the Z-axis direction (stacking direction). As described above with reference to FIGS. 6A and 6B, the configuration using this state is referred to as "in-plane magnetization scheme". In the in-plane magnetization scheme, the first magnetic layer 11 is made of an in-plane magnetization film. In the in-plane magnetization scheme, the second magnetic layer 12 is made of an in-plane magnetization film.

For instance, the first magnetic layer 11 functions as a reference layer. The second magnetic layer 12 functions as a free layer. In the free layer, the direction of the magnetization is easily changed by the external magnetic field. The direction of the magnetization of the reference layer is changed less easily than e.g. the direction of the magnetization of the free layer. The reference layer is e.g. a pin layer. Alternatively, both the first magnetic layer 11 and the second magnetic layer 12 may be free layers.

For instance, when a stress is applied to a ferromagnetic body, the inverse magnetostriction effect occurs in the ferromagnetic body. By the stress applied to the strain sensing element 15, the direction of the magnetization of the magnetic layer is changed based on the inverse magnetostriction effect. The angle between the direction of the magnetization of the first magnetic layer 11 and the direction of the magnetization of the second magnetic layer 12 is changed. Thus, for instance, by the MR (magnetoresistive) effect, the electrical resistance of the strain sensing element 15 is changed.

In the pressure sensing element 40, by the stress applied to the pressure sensing element 40, a displacement occurs in the film 30. Thus, a stress is applied to the strain sensing element 15, and the electrical resistance of the strain sensing element 15 is changed. The pressure sensing element 40 senses the stress using this effect.

FIGS. 9A to 9D are schematic perspective views illustrating a configuration and the characteristics of the pressure sensing element according to the embodiments.

Figure 9A:
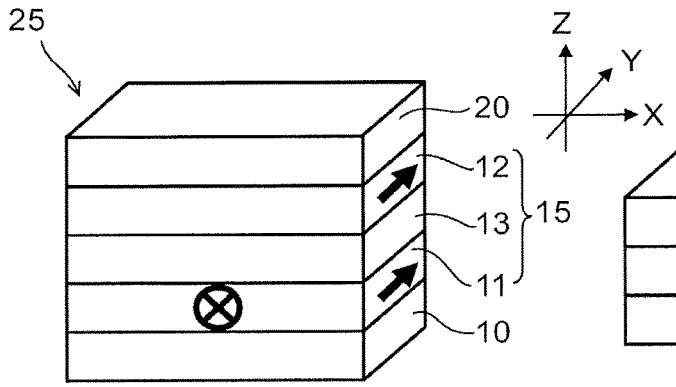
FIGS. 9A to 9D are schematic perspective views illustrating a configuration and the characteristics of the pressure sensing element according to the embodiments.
Figure 9B:
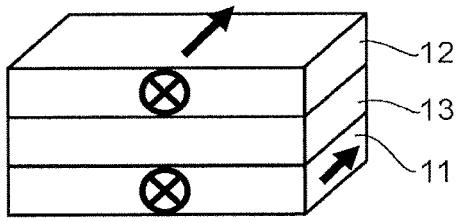
Figure 9C:
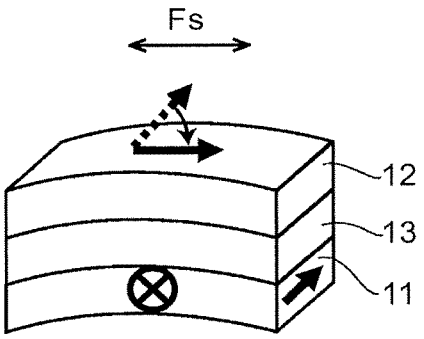
Figure 9D:
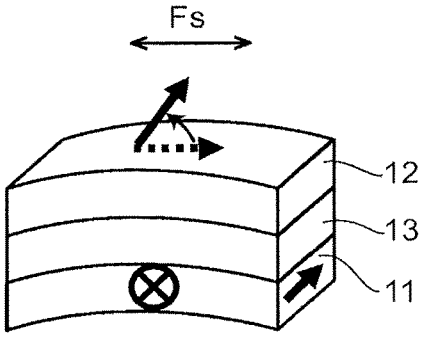

FIG. 9A illustrates the configuration of the device 25. FIG. 9B illustrates the state of the strain sensing element 15 under no application of stress. FIG. 9C illustrates the state of the strain sensing element 15 having a positive magnetostriction constant under application of a tensile stress. FIG. 9D illustrates the state of the strain sensing element 15 having a negative magnetostriction constant under application of a tensile stress.

As shown in FIG. 9A, on the first electrode 10, the first magnetic layer 11 (reference layer), the non-magnetic layer 13, the second magnetic layer 12 (magnetization free layer), and the second electrode 20 are stacked in this order. This example is of the in-plane magnetization scheme. The direction of the magnetization of the first magnetic layer 11 (as well as the direction of the magnetization of the second magnetic layer 12) is e.g. substantially parallel to the X-Y plane. The embodiments are not limited thereto. The angle between the direction of the magnetization of the first magnetic layer 11 and the direction parallel to the X-Y plane (first major surface 30*s*) is less than 45°. In the case where the magnetostriction constant of the magnetic layer is positive, the magnetization easy axis of the magnetic layer is parallel to the direction of application of the tensile stress. In the case where the magnetostriction constant of the magnetic layer is negative, the magnetization easy axis of the magnetic layer is perpendicular to the direction of application of the tensile stress.

As shown in FIG. 9B, under no application of stress, the direction of the magnetization of the second magnetic layer 12 (magnetization free layer) is e.g. parallel to the direction of the magnetization of the first magnetic layer 11 (reference layer). In this example, the direction of the magnetization is directed along the Y-axis direction.

As shown in FIG. 9C, for instance, a tensile stress Fs is applied along the X-axis direction. Then, by the inverse magnetostriction effect with a positive magnetostriction constant, the magnetization of the second magnetic layer 12 is rotated toward the X-axis direction. If the magnetization of the first magnetic layer 11 is fixed, the relative angle between the direction of the magnetization of the second magnetic layer 12 and the direction of the magnetization of the first magnetic layer 11 is changed. In response to the change of the relative angle, the electrical resistance of the strain sensing element 15 is changed.

As shown in FIG. 9D, for instance, a tensile stress Fs is applied along the Y-axis direction. Then, by the inverse magnetostriction effect with a negative magnetostriction constant, the magnetization of the second magnetic layer 12 is rotated toward the X-axis direction. Also in this case, by the application of the tensile stress Fs, the relative angle between the direction of the magnetization of the second magnetic layer 12 and the direction of the magnetization of the first magnetic layer 11 is changed. In response to the change of the relative angle, the electrical resistance of the strain sensing element 15 is changed.

FIGS. 10A to 10D are schematic perspective views illustrating an alternative configuration and the characteristics of the pressure sensing element according to the embodiments.

Figure 10A:
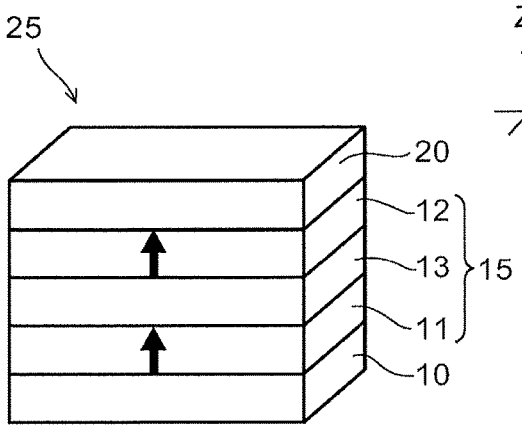
FIGS. 10A to 10D are schematic perspective views illustrating an alternative configuration and the characteristics of the pressure sensing element according to the embodiments.
Figure 10B:
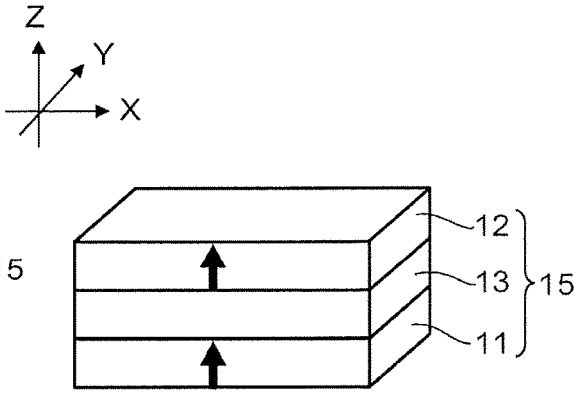
Figure 10C:
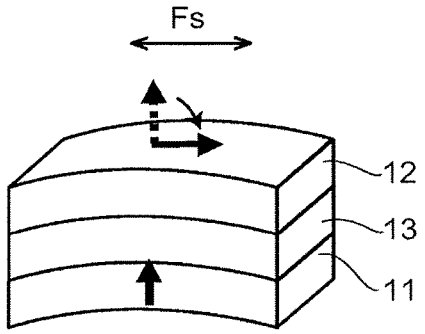
Figure 10D:
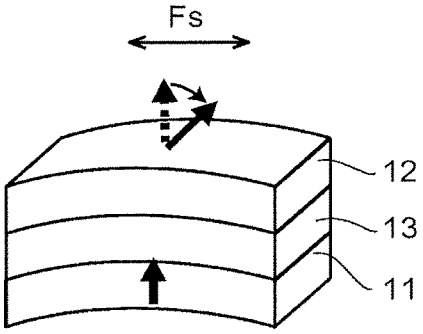

FIG. 10A illustrates the configuration of the device 25. FIG. 10B illustrates the state of the strain sensing element 15 under no application of stress. FIG. 10C illustrates the state of the strain sensing element 15 having a positive magnetostriction constant under application of a tensile stress. FIG. 10D illustrates the state of the strain sensing element 15 having a negative magnetostriction constant under application of a tensile stress.

As shown in FIG. 10A, this example is of the perpendicular magnetization scheme. The direction of the magnetization of the first magnetic layer 11 (as well as the direction of the magnetization of the second magnetic layer 12) is e.g. substantially parallel to the Z-axis direction. The embodiments are not limited thereto. The angle between the direction of the magnetization of the first magnetic layer 11 and the direction parallel to the X-Y plane (first major surface 30*s*) is greater than 45°.

As shown in FIG. 10B, under no application of stress, the direction of the magnetization of the second magnetic layer 12 (magnetization free layer) is e.g. parallel to the direction of the magnetization of the first magnetic layer 11 (reference layer). In this example, the direction of the magnetization is directed along the Y-axis direction.

As shown in FIG. 10C, for instance, a tensile stress Fs is applied along the X-axis direction. Then, by the inverse magnetostriction effect with a positive magnetostriction constant, the magnetization of the second magnetic layer 12 is rotated toward the X-axis direction. The relative angle between the direction of the magnetization of the second magnetic layer 12 and the direction of the magnetization of the first magnetic layer 11 is changed. In response to the change of the relative angle, the electrical resistance of the strain sensing element 15 is changed.

As shown in FIG. 10D, for instance, a tensile stress Fs is applied along the Y-axis direction. Then, by the inverse magnetostriction effect with a negative magnetostriction constant, the magnetization of the second magnetic layer 12 is rotated toward the X-axis direction. By the application of the tensile stress Fs, the relative angle between the direction of the magnetization of the second magnetic layer 12 and the direction of the magnetization of the first magnetic layer 11 is changed. In response to the change of the relative angle, the electrical resistance of the strain sensing element 15 is changed.

In the following, in the case of the configuration of the in-plane magnetization scheme, an example of the configuration of the strain sensing element 15 is described.

For instance, in the case where the first magnetic layer 11 is a reference layer, the first magnetic layer 11 is made of e.g. FeCo alloy, CoFeB alloy, or NiFe alloy. The thickness of the first magnetic layer 11 is e.g. 2 nm (nanometers) or more and 6 nm or less.

The non-magnetic layer 13 is made of metal or insulator. The metal is e.g. Cu, Au, or Ag. The thickness of the non-magnetic layer 13 made of metal is e.g. 1 nm or more and 7 nm or less. The insulator is e.g. magnesium oxide (such as MgO), aluminum oxide (such as $Al_2O_3$), titanium oxide (such as TiO), or zinc oxide (such as ZnO). The thickness of the non-magnetic layer 13 made of insulator is e.g. 0.6 nm or more and 2.5 nm or less.

In the case where the second magnetic layer 12 is a magnetization free layer, the second magnetic layer 12 is made of e.g. FeCo alloy or NiFe alloy. Besides, the second magnetic layer 12 can be made of Fe—Co—Si—B alloy, Tb-M-Fe alloy with $\lambda s>100$ ppm (M being Sm, Eu, Gd, Dy, Ho, or Er), Tb-M1-Fe-M2 alloy (M1 being Sm, Eu, Gd, Dy, Ho, or Er, and M2 being Ti, Cr, Mn, Co, Cu, Nb, Mo, W, or Ta), Fe-M3-M4-B alloy (M3 being Ti, Cr, Mn, Co, Cu, Nb, Mo, W, or Ta, and M4 being Ce, Pr, Nd, Sm, Tb, Dy, or Er), Ni, Al—Fe, or ferrite (such as $Fe_3O_4$ and $(FeCo)_3O_4$). The thickness of the second magnetic layer 12 is e.g. 2 nm or more.

The second magnetic layer 12 can have a two-layer structure. In this case, a stacked film of a layer of FeCo alloy and the following layer is used. The layer stacked with the layer of FeCo alloy is made of a material selected from e.g. Fe—Co—Si—B alloy, Tb-M-Fe alloy with $\lambda s>100$ ppm (M being Sm, Eu, Gd, Dy, Ho, or Er), Tb-M1-Fe-M2 alloy (M1 being Sm, Eu, Gd, Dy, Ho, or Er, and M2 being Ti, Cr, Mn, Co, Cu, Nb, Mo, W, or Ta), Fe-M3-M4-B alloy (M3 being Ti, Cr, Mn, Co, Cu, Nb, Mo, W, or Ta, and M4 being Ce, Pr, Nd, Sm, Tb, Dy, or Er), Ni, Al—Fe, and ferrite (such as $Fe_3O_4$ and $(FeCo)_3O_4$).

The magnetization direction of at least one magnetic layer of the first magnetic layer 11 and the second magnetic layer 12 is changed in response to the stress. The absolute value of the magnetostriction constant of the at least one magnetic layer (the magnetic layer in which the magnetization direction is changed in response to the stress) is set to e.g. $10^{-5}$ or more. Thus, by the inverse magnetostriction effect, the direction of the magnetization is sufficiently changed in response to the externally applied strain.

For instance, the non-magnetic layer 13 is made of oxide such as MgO. Then, the magnetic layer on the MgO layer typically has a positive magnetostriction constant. For instance, in the case where the second magnetic layer 12 is formed on the non-magnetic layer 13, a magnetization free layer having a stacked configuration of CoFeB/CoFe/NiFe is used as the second magnetic layer 12. If the uppermost NiFe layer is made Ni-rich, the magnetostriction constant of NiFe is made negative and has a large absolute value. In order to suppress cancelation of the positive magnetostriction on the oxide layer, the Ni composition of the uppermost NiFe layer is not made Ni-rich. Specifically, the proportion of Ni in the uppermost NiFe layer is preferably set to less than 80 atomic percent. In the case where the second magnetic layer 12 is a magnetization free layer, the thickness of the second magnetic layer 12 is preferably e.g. 1 nm or more and 20 nm or less.

In the case where the second magnetic layer 12 is a magnetization free layer, the first magnetic layer 11 may be either a reference layer or a magnetization free layer. In the case where the first magnetic layer 11 is a reference layer, the direction of the magnetization of the first magnetic layer 11 is not substantially changed even under application of external strain. The electrical resistance is changed based on the relative magnetization angle between the direction of the magnetization of the first magnetic layer 11 and the direction of the magnetization of the second magnetic layer 12.

In the case where the first magnetic layer 11 and the second magnetic layer 12 are both magnetization free layers, for instance, the magnetostriction constant of the first magnetic layer 11 is different from the magnetostriction constant of the second magnetic layer 12.

Irrespective of whether the first magnetic layer 11 is a reference layer or a magnetization free layer, the thickness of the first magnetic layer 11 is preferably e.g. 1 nm or more and nm or less.

In the case where the first magnetic layer 11 is a reference layer, the first magnetic layer 11 is based on a synthetic AF structure using a stacked structure of antiferromagnetic layer/magnetic layer/Ru layer/magnetic layer. The antiferromagnetic layer is made of e.g. IrMn. In the case where the first magnetic layer 11 is a reference layer, instead of using an antiferromagnetic layer, the first magnetic layer 11 may be based on a configuration using a hard film. The hard film is made of e.g. CoPt or FePt.

In the following, in the case of the configuration of the perpendicular magnetization scheme, an example of the configuration of the strain sensing element 15 is described. For instance, in the case where the first magnetic layer 11 is a reference layer, the first magnetic layer 11 is based on a stacked configuration of e.g. CoFe (2 nm)/CoFeB (1 nm). By the pinning layer, the direction of the magnetization is fixed to the film surface direction.

The non-magnetic layer 13 can be made of metal or insulator. The metal can be e.g. Cu, Au, or Ag. The thickness of the non-magnetic layer 13 made of metal is e.g. 1 nm or more and 7 nm or less. The insulator can be e.g. magnesium oxide (such as MgO), aluminum oxide (such as $Al_2O_3$), titanium oxide (such as TiO), or zinc oxide (such as ZnO). The thickness of the non-magnetic layer 13 made of insulator is e.g. 0.6 nm or more and 2.5 nm or less.

In the case where the second magnetic layer 12 is a magnetization free layer, the second magnetic layer 12 has a magnetization perpendicular to the film surface. In order to obtain the magnetization direction perpendicular to the film surface, for instance, the second magnetic layer 12 can be made of e.g. CoFeB (1 nm)/TbFe (3 nm). By using CoFeB at the interface on MgO, the MR ratio can be increased. However, perpendicular magnetic anisotropy is difficult to achieve by a monolayer of CoFeB. Thus, an additional layer exhibiting perpendicular magnetic anisotropy is used. For this function, for instance, a TbFe layer is used. A TbFe layer with Tb being atomic percent or more and 40 atomic percent or less exhibits perpendicular magnetic anisotropy. By using such a stacked film configuration, the direction of the magnetization of the entire magnetization free layer is directed in the direction perpendicular to the film surface due to the effect of the TbFe layer. By the effect of the CoFeB layer at the MgO interface, a large MR rate of change can be maintained. The TbFe layer has a very large positive magnetostriction constant, with the value being approximately $+10^{-4}$. By this large magnetostriction constant, the magnetostriction constant of the entire magnetization free layer can be easily set to a value as large as $+10^{-6}$. Furthermore, it is also possible to obtain a magnetostriction constant larger than $+10^{-5}$.

The TbFe layer can develop two functions: the magnetization direction directed perpendicular to the film surface, and a large magnetostriction constant. While using this material, other elements may be added as needed.

In order to obtain perpendicular magnetic anisotropy, materials other than TbFe may be used. The second magnetic layer 12 can be made of e.g. CoFeB (1 nm)/(Co (1 nm)/Ni (1 nm))×n (n being 2 or more). The Co/Ni multilayer film develops perpendicular magnetic anisotropy. The thickness of the Co film and the Ni film is approximately 0.5 nm or more and 2 nm or less.

The absolute value of the magnetostriction constant of the entire magnetization free layer is $10^{-6}$ or more. In order to increase the magnetostriction constant, an additional layer of e.g. FeSiB having a large magnetostriction constant is used. FeSiB exhibits a large positive magnetostriction constant (approximately $+10^{-4}$). Thus, the magnetization free layer as a whole achieves a large positive magnetostriction constant. It is also possible to apply a configuration such as CoFeB (1 nm)/(Co (1 nm)/Ni (1 nm))×n/FeSiB (2 nm).

The second magnetic layer 12 can be based on e.g. a stacked film of Mp and Ml. Mp is a magnetic layer exhibiting perpendicular magnetic anisotropy, and Ml is a magnetic layer exhibiting a large magnetostriction constant. The second magnetic layer 12 can be made of a multilayer film such as Mp/Ml, Ml/Mp, Mp/x/Ml, Ml/x/Mp, x/Ml/Mp, Ml/Mp/x, x/Mp/Ml, or Mp/Ml/x. The additional layer x can be used as needed when the function obtained by Ml and Mp alone is insufficient. For instance, in order to increase the MR rate of change, the x layer is provided at the interface with the non-magnetic layer 13. This x layer can be e.g. a CoFeB layer or CoFe layer.

The magnetic layer Mp can be made of CoPt—$SiO_2$ granular, FePt, CoPt, CoPt, Co/Pd multilayer film, Co/Pt multilayer film, or Co/Ir multilayer film. TbFe and Co/Ni multilayer film can be regarded as materials having the function of Mp. The number of layers in the multilayer film is e.g. 2 or more and 10 or less.

The magnetic layer Ml can be made of Ni, Ni alloy (alloy containing a large amount of Ni such as $Ni_{95}Fe_5$), SmFe, DyFe, or a magnetic oxide material containing Co, Fe, or Ni. TbFe and Co/Ni multilayer film can be used for a layer having not only the function of Mp but also the function of Ml. It is also possible to use an amorphous alloy layer based on FeSiB. Ni, Ni-rich alloy, and SmFe exhibit a large negative magnetostriction constant. In this case, the magnetization free layer is caused to function so that the signature of the magnetostriction of the entire magnetization free layer is negative. Oxide magnetic materials containing Fe, Co, or Ni such as $CoO_x$, $FeO_x$, or $NiO_x$ ($0<x<0.8$) exhibit a large positive magnetostriction constant. In this case, the signature of the magnetostriction of the entire magnetization free layer is positive.

In order to develop magnetic anisotropy perpendicular to the film surface, the Mp materials as described above can be used. However, as the case may be, the CoFeB layer regarded as the aforementioned x layer used at the interface with the non-magnetic layer can be caused to function as Mp. In this case, the thickness of the CoFeB layer is made thinner than 1 nm. Then, it is also possible to develop magnetic anisotropy perpendicular to the film surface.

In both cases of the in-plane magnetization scheme and the perpendicular magnetization scheme, the first electrode 10 and the second electrode 20 are made of e.g. a non-magnetic body such as Au, Cu, Ta, or Al. The first electrode 10 and the second electrode 20 are made of a soft magnetic material. This can reduce external magnetic noise affecting the strain sensing element 15. The soft magnetic material is e.g. permalloy (NiFe alloy) or silicon steel (FeSi alloy).

The periphery of the strain sensing element 15 is surrounded with the insulating layer 14. The insulating layer 14 is made of e.g. aluminum oxide (e.g., $Al_2O_3$) or silicon oxide (e.g., $SiO_2$). The insulating layer 14 electrically insulates between the first electrode 10 and the second electrode 20.

For instance, in the case where the non-magnetic layer 13 is made of metal, the GMR effect is developed. In the case where the non-magnetic layer 13 is made of insulator, the TMR effect is developed. The strain sensing element 15 is based on e.g. the CPP (current perpendicular to plane)-GMR effect in which the current is passed along the stacking direction.

Figure 11A:
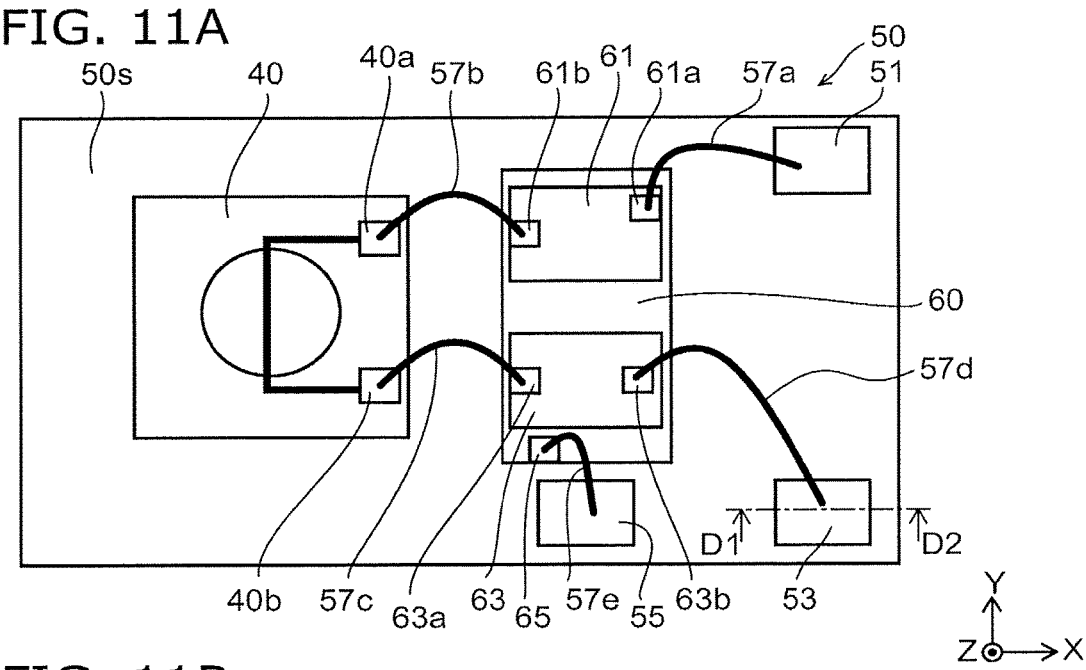
FIGS. 11A to 11C are schematic views illustrating a configuration of the mounting substrate of the embodiments.
Figure 11B:
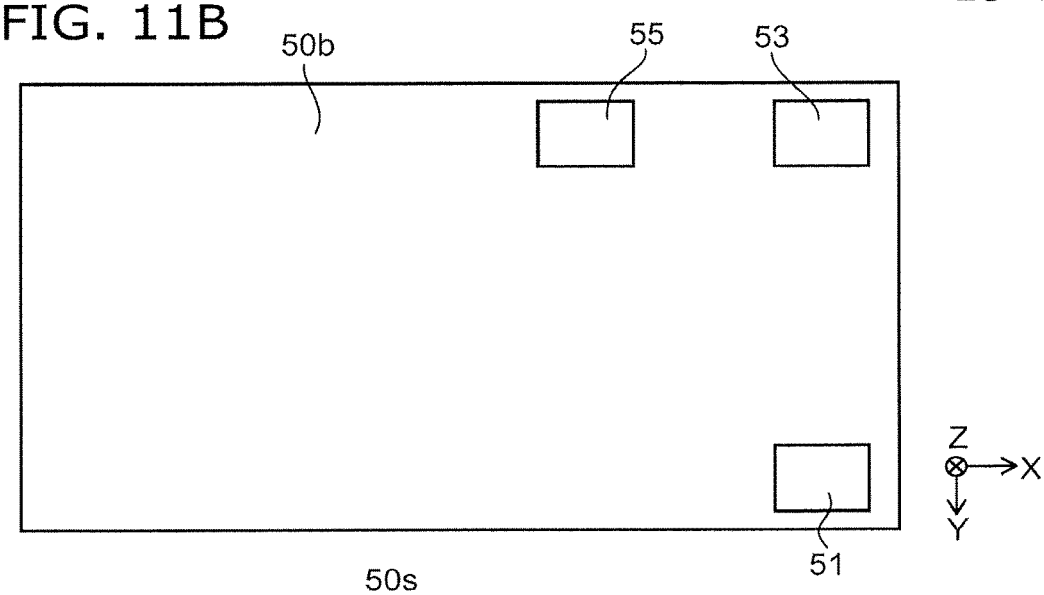
Figure 11C:
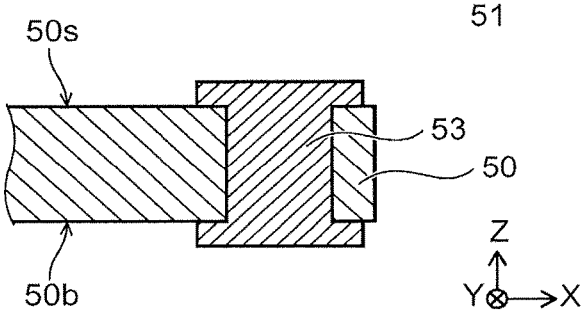

FIGS. 11A to 11C are schematic views illustrating a configuration of the mounting substrate of the embodiments.

FIG. 11A is a schematic plan view of the first major surface 50*s*. FIG. 11B is a schematic plan view of the second major surface 50*b*. FIG. 11C is a sectional view taken along line D1-D2 of FIG. 11A.

As shown in FIGS. 11A and 11B, the mounting substrate 50 includes an external power supply electrode pad 51, an output terminal electrode pad 53, and a ground electrode pad 55. As shown in FIG. 11C, by the application of surface mounting technology, the output terminal electrode pad 53 is provided from the first major surface 50*s* through a through hole to the second major surface 50*b*. By the output terminal electrode pad 53, the first major surface 50*s* is electrically connected to the second major surface 50*b*. This also applies to the external power supply electrode pad 51 and the ground electrode pad 55.

The driving circuit 61 includes a driving circuit input electrode pad 61*a* and a driving circuit output electrode pad 61*b*. The signal processing circuit 63 includes a signal processing circuit input electrode pad 63*a* and a signal processing circuit output electrode pad 63*b*. The integrated circuit 60 includes an integrated circuit output electrode pad 65. The pressure sensing element 40 includes a pressure sensing element input electrode pad 40*a* and a pressure sensing element output electrode pad 40*b*.

The external power supply 141 (see FIG. 5) is electrically connected to the external power supply electrode pad 51. The external power supply electrode pad 51 is electrically connected to the driving circuit input electrode pad 61*a* by a first wire 57*a*. The driving circuit output electrode pad 61*b* is electrically connected to the pressure sensing element input electrode pad 40*a* by a second wire 57*b*. The pressure sensing element output electrode pad 40*b* is electrically connected to the signal processing circuit input electrode pad 63*a* by a third wire 57*c*. The signal processing circuit output electrode pad 63*b* is electrically connected to the output terminal electrode pad 53 by a fourth wire 57*d*. The output terminal electrode pad 53 is electrically connected to the output terminal 143 (see FIG. 5). The integrated circuit output electrode pad 65 is electrically connected to the ground electrode pad 55 by a fifth wire 57*e*. The integrated circuit 60 is grounded via the integrated circuit output electrode pad 65, the fifth wire 57*e*, and the ground electrode pad 55.

Figure 12A:
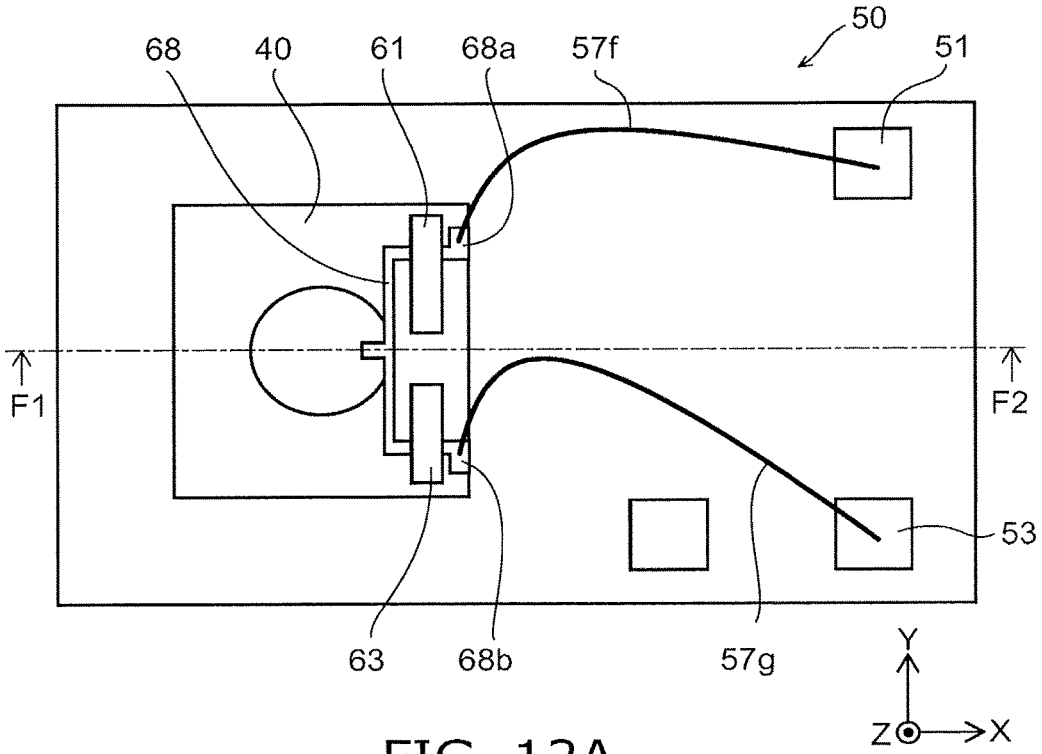
FIGS. 12A and 12B are schematic views illustrating an alternative configuration of the mounting substrate of the embodiments.
Figure 12B:
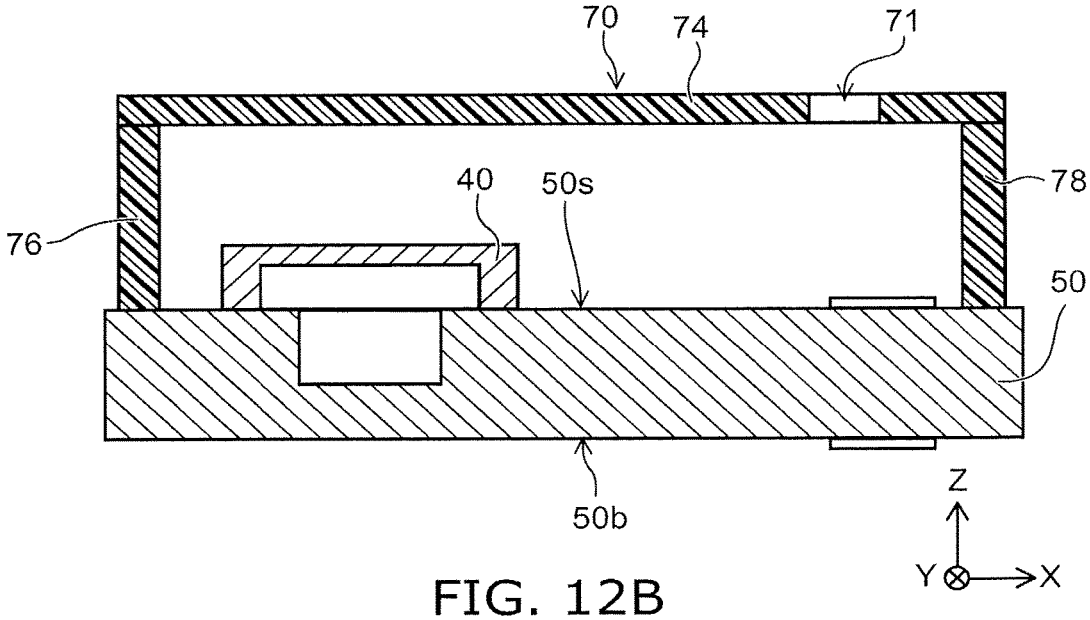
Figure 13:
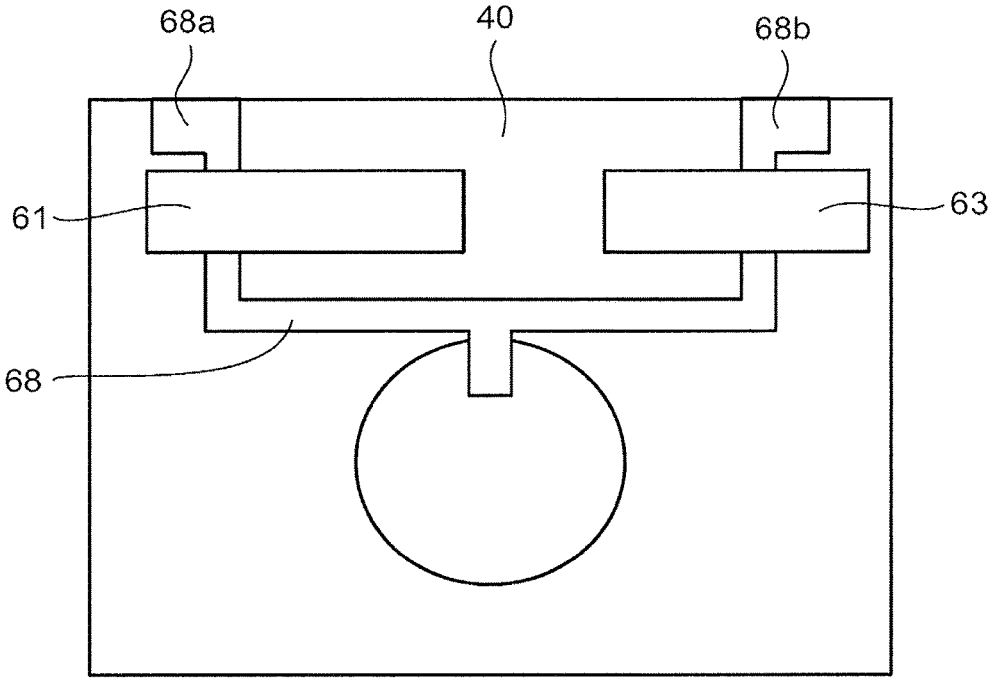
FIG. 13 is a schematic view illustrating an alternative configuration of the mounting substrate of the embodiments.

FIGS. 12A, 12B, and 13 are schematic views illustrating an alternative configuration of the mounting substrate of the embodiments.

FIG. 12A is a schematic plan view of the first major surface 50*s*. FIG. 12B is a sectional view taken along line F1-F2 of FIG. 12A. FIG. 13 is a schematic enlarged view of the pressure sensing element 40. For convenience of description, in FIG. 12B, the cover 70 is not shown.

In the alternative configuration of the mounting substrate 50 shown in FIGS. 12A, 12B, and 13, the driving circuit 61 is provided on the pressure sensing element 40. The signal processing circuit 63 is provided on the pressure sensing element 40. In other words, the driving circuit 61 and the signal processing circuit 63 are each incorporated on the pressure sensing element 40.

On the pressure sensing element 40, a third electrode 68 is provided. The third electrode 68 has a fifth portion 68*a* and a sixth portion 68*b*. The external power supply electrode pad 51 is electrically connected to the fifth portion 68*a* of the third electrode 68 by a sixth wire 57*f*. The sixth portion 68*b* of the third electrode 68 is electrically connected to the output terminal electrode pad 53 by a seventh wire 57*g*.

In the case where the membrane 34 (see, e.g., FIGS. 8A to 8C) is formed of silicon, the region of the pressure sensing element 40 other than the strain sensing element 15 is made of silicon. Thus, the driving circuit 61 and the signal processing circuit 63 can be formed of silicon transistors by using the semiconductor formation method.

In the specification of the application, "perpendicular" and "parallel" refer to not only strictly perpendicular and strictly parallel but also include, for example, the fluctuation due to manufacturing processes, etc. It is sufficient to be substantially perpendicular and substantially parallel.

The embodiments of the invention have been described above with reference to examples. However, the invention is not limited to these examples. For instance, any specific configurations of various components such as the cover and magnetic body included in the microphone package, and the electrode, magnetic layer, non-magnetic layer, strain sensing element, device, membrane, and mounting substrate included in the pressure sensing element are encompassed within the scope of the invention as long as those skilled in the art can similarly practice the invention and achieve similar effects by suitably selecting such configurations from conventionally known ones.

Further, any two or more components of the specific examples may be combined within the extent of technical feasibility and are included in the scope of the embodiments to the extent that the spirit of the embodiments is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sensor comprising:

a substrate;

a cover, a part of the cover including a magnetic body;

a film provided between the substrate and the cover, a first cavity being provided between the film and the cover; and an element provided on the film between the substrate and the cover, the element including a first magnetic layer, a second magnetic layer, and a non-magnetic layer provided between the first magnetic layer and the second magnetic layer.

2. The sensor according to claim 1, wherein a second cavity is provided between the film and the substrate.

3. The sensor according to claim 1, wherein the part of the cover overlaps the second magnetic layer in a direction of the magnetization of the second magnetic layer.

4. The sensor according to claim 1, wherein
an electrical resistance between the first magnetic layer and the second magnetic layer changes depending on a strain of the film body.

5. The sensor according to claim 1, wherein
the element is provided between the film and the cover.

6. The sensor according to claim 1, wherein
the part of the cover includes a part of a side portion of the cover.

7. The sensor according to claim 1, wherein
the part of the cover comprises a magnetic material.

8. A sensor comprising:
a substrate;
a cover, a part of the cover including a magnetic body;
a film provided between the substrate and the cover, a cavity being provided between the film and the substrate; and
an element provided on the film between the substrate and the cover, the element including a first magnetic layer, a second magnetic layer, and a non-magnetic layer provided between the first magnetic layer and the second magnetic layer.

9. The sensor according to claim 8, wherein
an electrical resistance between the first magnetic layer and the second magnetic layer changes depending on a strain of the film body.

10. A sensor comprising:
a substrate;
a cover, a part of the cover including a magnetic body;
a film provided between the substrate and the cover, the film being deformable; and
an element provided on the film between the substrate and the cover, the element including a first magnetic layer, a second magnetic layer, and a non-magnetic layer provided between the first magnetic layer and the second magnetic layer.

11. The sensor according to claim 10, wherein
an electrical resistance between the first magnetic layer and the second magnetic layer changes depending on a strain of the film body.

12. An electric circuit comprising:
the sensor according to claim 1; and
a power supply connected with the package.

13. An electric circuit comprising:
the sensor according to claim 8; and
a power supply connected with the package.

14. An electric circuit comprising:
the sensor according to claim 10; and
a power supply connected with the package.

* * * * *